US006558893B1

(12) United States Patent
Parton et al.

(10) Patent No.: US 6,558,893 B1
(45) **Date of Patent: *May 6, 2003**

(54) PHOTOGRAPHIC MATERIAL HAVING IMPROVED COLOR REPRODUCTION

(75) Inventors: Richard L. Parton, Webster, NY (US); Andrei Andrievsky, Webster, NY (US); Thomas L. Penner, Fairport, NY (US); William J. Harrison, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/716,101

(22) Filed: Nov. 17, 2000

Related U.S. Application Data

(63) Continuation-in-part of application No. 09/394,912, filed on Sep. 13, 1999, now abandoned.

(51) Int. Cl.[7] ..... G03C 1/10; G03C 1/29

(52) U.S. Cl. ..... 430/574; 430/572; 430/578; 430/582; 430/583; 430/584; 430/586; 430/587; 430/588; 430/590; 430/591; 430/592

(58) Field of Search ..... 430/574, 572, 430/578, 583, 582, 584, 586, 587, 588, 590, 591, 592

(56) References Cited

U.S. PATENT DOCUMENTS

| | | | | |
|---|---|---|---|---|
| 2,518,731 | A | | 8/1950 | Thompson |
| 3,622,316 | A | | 11/1971 | Bird et al. |
| 3,976,493 | A | | 8/1976 | Borror et al. |
| 3,976,640 | A | | 8/1976 | Borror et al. |
| 4,025,349 | A | | 5/1977 | Mee |
| 4,040,825 | A | | 8/1977 | Stieger et al. |
| 4,138,551 | A | | 2/1979 | Steiger et al. |
| 4,889,796 | A | | 12/1989 | Ikegawa et al. |
| 4,950,587 | A | | 8/1990 | Roberts et al. |
| 4,970,141 | A | | 11/1990 | Ikegawa et al. |
| 5,198,332 | A | | 3/1993 | Ikegawa et al. |
| 5,523,203 | A | | 6/1996 | Nishigaki |
| 5,637,448 | A | | 6/1997 | Nakamura et al. |
| 6,143,486 | A | * | 11/2000 | Parton et al. ..... 430/574 |

FOREIGN PATENT DOCUMENTS

| | | | |
|---|---|---|---|
| EP | 0565074 | A2 | 3/1978 |
| EP | 0838719 | A2 | 12/1989 |
| EP | 0270082 | B1 | 6/1991 |
| EP | 0270079 | B1 | 7/1994 |
| EP | 0838719 | * | 4/1998 |
| EP | 0 985 964 | A1 | 3/2000 |
| EP | 0 985 966 | A1 | 3/2000 |
| JP | 1091134 | | 8/1979 |
| JP | 10171058 | | 6/1995 |
| JP | 10171058 | * | 6/1998 |

OTHER PUBLICATIONS

George R. Bird, Overcoming the Limitation of Incomplete Absorption in Sensitization with Cyanine Dyes Sep./Oct. 1974, pp. 562–568, Photographic Science and Engineering, vol. 18.

Th. Forester, 10$^{th}$ Spiers Memorial Lecture Transfer Mechanisms of Electronic Excitation, Apr. 1959, pp. 7–17, Energy Transfer With Special Reference to Biological Systems, No. 27.

R. Steiger, Gelatin–Substituted Cynanine Dyes as Spectral Sensitizers for Silver Halide Emulsions, 1983, pp.59–65, Photographic Science and Engineering, vol. 27.

Thomas L. Penner, Electrophoresis of Spectral Sensitizing Dyes on Silver Halide: Evidenvce for Dye Layering, 1977, pp. 32–36, Photographic Science and Engineering, vol. 21.

Thomas L. Penner, P.B. Gilman, Jr., Spectral Shifts and Physical Layering of Sensitizing Dye Combinations in Silver Halide Emulsions, 1976, Photographic Science and Engineering, vol. 20.

* cited by examiner

*Primary Examiner*—Thorl Chea
(74) *Attorney, Agent, or Firm*—Edith A. Rice

(57) ABSTRACT

This invention comprises a silver halide photographic material comprising at least one silver halide emulsion comprising silver halide grains having associated therewith a combination of two or more dyes comprising:

(a) a first dye which is a cyanine dye of formula Ia and has a net charge of zero or −1

(Ia)

wherein the substituents are as defined in the specification;

(b) a second dye which has at least one substituent that has a positive charge, and is a cyanine dye a merocyanine dye, arylidene dye, complex cyanine dye, complex merocyanine dye, homopolar cyanine dye, hemicyanine dye, styryl dye, hemioxonol dye, oxonol dye, anthraquinone dye, triphenylmethane dye, azo dye type, azomethines, or a coumarin dye, with the proviso that if the second dye is a cyanine dye, it is of formula IIa:

(IIa)

wherein the substituents are as defined in the specification; and wherein (c) the wavelength of maximum light absorption, in nanometers (nm), of the first dye and the wavelength of maximum light absorption of the second dye differ by at least 10 nm.

20 Claims, No Drawings

PHOTOGRAPHIC MATERIAL HAVING IMPROVED COLOR REPRODUCTION

CROSS REFERENCE TO RELATED APPLICATIONS

This application is a continuation-in-part of application Ser. No. 09/394,912 filed Sep. 13, 1999, abandoned the entire disclosure of which is incorporated herein by reference.

This application is related to the following commonly assigned, co-pending applications: U.S. application Ser. No. 09/151,974 filed Sep. 11, 1998; U.S. application Ser. No. 09/151,915 filed Sep. 11, 1998; U.S. application Ser. No. 09/151,916 filed Sep. 11, 1998; U.S. application Ser. No. 09/151,977 filed Sep. 11, 1998; U.S. application Ser. No. 09/394,921 filed Sep. 13, 1999. The entire disclosures of these related applications are incorporated herein by reference.

FIELD OF THE INVENTION

This invention relates to silver halide photographic material containing at least one silver halide emulsion which has improved color reproduction and enhanced photographic sensitivity.

BACKGROUND OF THE INVENTION

A multicolor photographic material typically comprises a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, a yellow dye image-forming unit comprising at least one blue-sensitive silver halide emulsion layer having associated therewith at least one yellow dye-forming coupler. One of the challenges of preparing photographic materials is to have each of the red, green, and blue sensitive emulsions absorb light as close as possible to the wavelength of light sensitivity of the human eye in that color range of the spectrum.

The human eye is most sensitive to green light. Thus the green light sensitive layer of photographic materials can have a large impact on perceived color reproduction. This layer is generally sensitive to light within the wavelength region of 500 to 600 nm. In photographic materials, it is common practice to sensitize this layer with a sensitizing dye that has a maximum sensitivity at about 550 nm. However, the human eye has a peak sensitivity at about 540 nm, and still has substantial sensitivity at 500 nm. Additional efficient sensitization in the region of 500 to 540 nm would enable more accurate color reproduction for color negative films.

Benzimidazolooxacarbocyanines can provide spectral sensitivity in the region of 520 to 540 nm. Oxacarbocyanines are another class of dyes that afford efficient J-aggregate sensitization in the green region. Ikegawa et. al. (U.S. Pat. Nos. 5,198,332, 4,970,141, and 4,889,796) and Nakamura et. al. (U.S. Pat. No. 5,637,448) describe oxacarbocyanine dyes that provide spectral sensitivity below 545 nm. U.S. Pat. No. 5,523,203 describes another class of short green sensitizers. Commonly assigned co-pending application Ser. No. 09/259,992 filed Mar. 1, 1999 also discloses short green sensitizing dyes. Acetylenic dyes, described in U.S. Pat. No. 4,025,349 can also provide short green sensitization.

However, addition of any of the above mentioned short green dyes requires that some of the mid-green sensitizer be removed since there is only limited space on the silver halide grains. This results in an increased sensitivity in the short green wavelengths, but a decrease in sensitivity at the mid-green region. Thus it would be desirable if the short green sensitivity could be increased without significantly decreasing the mid-green sensitivity.

In many photographic products, for example, color negative films, the blue spectral region, 400–500 nm, has been often sensitized with a dye that has its maximum sensitivity at about 470 nm while the eye sensitivity has a peak at approximately 440 nm, and fluorescent lights have a peak emission at 435 nm. A broader blue sensitization envelope could improve the sensitivity of the film color balance to changes in illuminant, especially fluorescent light. This type of spectral envelope can be obtained by combining a dye that has a maximum sensitization at 470 nm with a dye that has a maximum peak at a shorter wavelength. Thus dyes that aggregate at a shorter wavelength, for example oxathiacyanine dyes, that aggregate in the region of 400–460 nm are desirable. However, adding a short blue dye requires that some of the mid-blue dye be removed because of the limited surface area on silver halide grains. This can result in a substantial decrease in mid-blue sensitivity. In the yellow layer it would be desirable to increase short-blue sensitivity while maintaining mid-blue sensitivity.

The red sensitivity of the human eye peaks at approximately 590 nm. However, the red wavelength region, 600 to 700 nm, in many photographic products, for example color negative films, has been often sensitized with a dye that has its maximum sensitivity at about 650 nm. A change in the red spectral sensitization from a maximum at 650 nm to a position closer to 600 nm, for example in the 620 to 640 nm region, has several advantages. This could improve the sensitivity of the film color balance to changes in illuminant, especially fluorescent light. Also, some colors that are difficult to reproduce because of high infrared reflectance, would be reproduced more accurately. Thus increasing the sensitivity in the short red region is desirable.

To achieve a broad green, a broad blue, or a broad red sensitization and increase photographic sensitivity it is necessary to increase the light absorption of the silver halide emulsions. One way to achieve greater light absorption is to increase the amount of spectral sensitizing dye associated with the individual grains beyond monolayer coverage of dye (some proposed approaches are described in the literature, G. R. Bird, *Photogr. Sci. Eng.,* 18, 562 (1974)). One method is to synthesize molecules in which two dye chromophores are covalently connected by a linking group (see U.S. Pat. Nos. 2,518,731, 3,976,493, 3,976,640, 3,622,316, Kokai Sho 64(1989)91134, and EP 565,074). This approach suffers from the fact that when the two dyes are connected they can interfere with each other's performance, e.g., not aggregating on or adsorbing to the silver halide grain properly.

In a similar approach, several dye polymers were synthesized in which cyanine dyes were tethered to poly-L-lysine (U.S. Pat. No. 4,950,587). These polymers could be combined with a silver halide emulsion, however, they tended to sensitize poorly and dye stain (an unwanted increase in D-min due to retained sensitizing dye after processing) was severe in this system and unacceptable.

A different strategy involves the use of two dyes that are not connected to one another. In this approach the dyes can be added sequentially and are less likely to interfere with one another. Miysaka et al. in EP 270 079 and EP 270 082 describe silver halide photographic material having an emulsion spectrally sensitized with an adsorable sensitizing dye used in combination with a non-adsorable luminescent dye which is located in the gelatin phase of the element. Steiger et al. in U.S. Pat. Nos. 4,040,825 and 4,138,551 describe silver halide photographic material having an emulsion spectrally sensitized with an adsorable sensitizing dye used in combination with second dye which is bonded to gelatin. The problem with these approaches is that unless the dye not adsorbed to the grain is in close proximity to the dye adsorbed on the grain (less than 50 angstroms separation) efficient energy transfer will not occur (see T. Förster, *Disc. Faraday Soc.,* 27, 7 (1959)). Most dye off-the-grain in these systems will not be close enough to the silver halide grain for energy transfer, but will instead absorb light and act as a filter dye leading to a speed loss. A good analysis of the problem with this approach is given by Steiger et al. (*Photogr. Sci. Eng.,* 27, 59 (1983)).

A more useful method is to have two or more dyes form layers on the silver halide grain. Penner and Gilman described the occurrence of greater than monolayer levels of cyanine dye on emulsion grains, *Photogr. Sci. Eng.,* 20, 97 (1976); see also Penner, *Photogr. Sci. Eng.,* 21, 32 (1977). In these cases, the outer dye layer absorbed light at a longer wavelength than the inner dye layer (the layer adsorbed to the silver halide grain). Bird et al. in U.S. Pat. No. 3,622,316 describe a similar system. A requirement was that the outer dye layer absorb light at a shorter wavelength than the inner layer. The problem with prior art dye layering approaches was that the dye layers described produced a very broad sensitization envelope. This would lead to poor color reproduction since, for example, the silver halide grains in the same color record would be sensitive to both green and red light.

Yasuhiro et. al. (U.S. Pat. No. 4,518,689) describe an inner latent image type silver halide photographic emulsion spectrally sensitized with a cationic monomethine dye and an anionic monmethine dye.

Yamashita et. al. (EP 838 719 A2) describes the use of two or more cyanine dyes to form dye layers on silver halide emulsions. The preferred dyes are required to have at least one aromatic or heteroaromatic substitutent attached to the chromophore via the nitrogen atoms of the dye. This is undesirable because such substitutents can lead to large amounts of retained dye after processing (dye stain) which affords increased D-min. We have found that this is not necessary and that neither dye is required to have at least one aromatic or heteroaromatic substitute attached to the chromophore via the nitrogen atoms of the dye. The dyes of our invention give increased photographic sensitivity.

Yamashita et. al. (Japenese Kokai Patent Application No. Hei 10 [1998]-171058) describes the use of two or more dyes to form dye layers on silver halide emulsions characterized by containing an anionic dye and a cationic dye where the charge of either the anionic dye or the cationic dye is 2 or greater.

However, the methods described above do not sufficiently provide increased sensitivity and improved color reproduction. Thus, further technology is required.

PROBLEM TO BE SOLVED BY THE INVENTION

As discussed above, there exists a need for sensitizing a silver halide emulsions to green, blue or red light such that the maximum sensitivity of the emulsions is closer to the natural sensitivity of the human eye than is conventionally used in photographic materials. In each case, the maximum sensitivity of conventional silver halide emulsions is at a longer wavelength than the maximum sensitivity of the human eye. Therefore, the problem to be solved by this invention is to provide sensitizing dyes which can be used to sensitize silver halide emulsions in the relevant region of the spectrum, such that the maximum sensitivity of the emulsions is closer to the sensitivity of the human eye without a loss in photographic sensitivity and preferably with an increase in sensitivity.

SUMMARY OF THE INVENTION

We have found that it is possible to form more than one dye layer on silver halide emulsion grains and that this can afford increased light absorption. The dye layers are held together by a non-covalent attractive force such as electrostatic bonding, van der Waals interactions, hydrogen bonding, hydrophobic interactions, dipole-dipole interactions, dipole-induced dipole interactions, London dispersion forces, cation-π interactions, etc. or by in situ bond formation. In one preferred embodiment at least one dye containing at least one anionic substituent and at least one dye containing at least one cationic substituent are present. The inner dye layer(s) is absorbed to the silver halide grains and contains at least one spectral sensitizer. Preferably the dyes of the inner layer form a J-aggregate. The outer dye layer(s) (also referred to herein as an antenna dye layer(s)) also preferably aggregate and the aggregate absorbs light at a shorter wavelength, preferably at least 5 nm shorter, than the adjacent inner dye layer(s). The light energy emission wavelength of the outer dye layer overlaps with the light energy absorption wavelength of the adjacent inner dye layer. This results in increased sensitivity and improved color reproduction.

One aspect of the invention comprises a silver halide photographic material comprising at least one silver halide emulsion comprising silver halide grains having associated therewith a combination of two or more dyes comprising:

(a) a first dye which is a cyanine dye of formula Ia and has a net charge of zero or −1

(Ia)

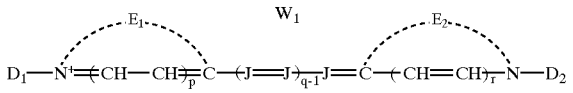

wherein:

$E_1$ and $E_2$ may be the same or different and represent the atoms necessary to form a substituted or unsubstituted heterocyclic ring which is a basic nucleus each J independently represents a substituted or unsubstituted methine group;

q is a positive integer of from 1 to 4;

p and r each independently represents 0 or 1;

$D_1$ and $D_2$ each independently represents substituted or unsubstituted alkyl or substituted or unsubstituted aryl and at least one of $D_1$ and $D_2$ contains an anionic substituent; and $W_1$ is one or more a counterions as necessary to balance the charge;

(b) a second dye which has at least one substituent that has a positive charge, and is a cyanine dye, a merocyanine dye, arylidene dye, complex cyanine dye, complex merocyanine dye, homopolar cyanine dye, hemicyanine dye, styryl dye, hemioxonol dye, oxonol dye, anthraquinone dye, triphenylmethane dye, azo dye type, azomethines, or a coumarin dye, with the proviso that if the second dye is a cyanine dye, it is of formula IIa:

(IIa)

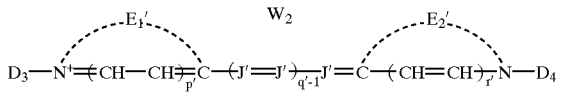

wherein:

$E_1'$ and $E_2'$ may be the same or different and represent the atoms necessary to form a substituted or unsubstituted heterocyclic ring which is a basic nucleus, with the proviso that $E_1'$ and $E_2'$ of formula IIa are not the same as $E_1$ and $E_2$ of formula (Ia);

each J' independently represents a substituted or unsubstituted methine group;

q' is a positive integer of from 1 to 4;

p' and r' each independently represents 0 or 1;

$D_3$ and $D_4$ each independently represents substituted or unsubstituted alkyl or substituted or unsubstituted aryl and at least one of $E_1'$, $E_2'$, J' or $D_3$ and $D_4$ contains a cationic substituent;

$W_2$ is one or more a counterions as necessary to balance the charge; and wherein (c) the wavelength of maximum light absorption, in nanometers (nm), of the first dye and the maximum light absorption of the second dye differ by at least 10 nm.

In a preferred embodiment the dyes differ in their wavelength of maximum light absorption by at least 10 nm but less than 60 nm.

In another preferred embodiment at least one of said dyes affords a maximum light absorption that is between 510 and 545 nm in the green light sensitive layer and/or at least one of said dyes affords a maximum light absorption that is between 410 and 460 nm in the blue light sensitive layer and/or at least one of said dyes affords a maximum light absorption that is between 610 and 635 nm in the red light sensitive layer.

In another preferred embodiment at least one of said dyes affords a maximum light absorption that is between 520 and 535 nm in the green light sensitive layer and/or at least one of said dyes affords a maximum light absorption that is between 420 and 445 nm in the blue light sensitive layer and/or at least one of said dyes affords a maximum light absorption that is between 610 and 625 nm in the red light sensitive layer.

In a preferred embodiment, the first dye layer consists of cyanine dyes having at least one negatively charged substituent. The cyanine dyes preferably have a net charge of 0 or −1. If the charge on the cyanine dyes of the first layer is less than −1, e.g., −2, then the cyanine dyes will not adsorb strongly to the silver halide substrate and will not be efficient sensitizers.

In another preferred embodiment both the antenna dye (i.e., the second dye) and the sensitizing dye (i.e., the first dye) form J-aggregates in a silver halide element. In order to get a broad light absorption envelope for improved color reproduction, the wavelength of maximum light absorption of the J-aggregate of the antenna dye and the wavelength of maximum light absorption of the J-aggregate of the sensitizing dye should differ by at least 5 nm and preferably by at least 10 nm.

ADVANTAGEOUS EFFECT OF THE INVENTION

This invention affords improved color reproduction and enhanced photographic sensitivity.

DESCRIPTION OF PREFERRED EMBODIMENTS

In preferred embodiments of the invention silver halide grains have associated therewith dyes layers that are held together by non-covalent attractive forces. Examples of non-covalent attractive forces include electrostatic attraction, hydrophobic interactions, hydrogen-bonding, van der Waals interactions, dipole-dipole interactions, dipole-induced dipole interactions, London dispersion forces, cation-π interactions or any combinations of these. In addition, in situ bond formation between complementary chemical groups is valuable for this invention. For example, one layer of dye containing at least one boronic acid substituent can be formed. Addition of a second dye having at least one diol substituent results in the formation of two dye layers by the in situ formation of boron-diol bonds between the dyes of the two layers. Another example of in situ bond formation is the formation of a metal complex between dyes that are adsorbed to silver halide and dyes that can form a second or subsequent layer. For example, zirconium could be useful for binding dyes with phosphonate substitutents into dye layers. For a non-silver halide example see H. E. Katz et. al., Science, 254, 1485, (1991). Also see A. Shanzer et. al., Chem. Eur. J., 4, 502, (1998).

Preferably the dyes of the inner layer (the primary sensitizer) form a J-aggregate. For a discussion of J-aggregation see *The Theory of the Photographic Process*, 4$^{th}$ edition, T. H. James, editor, Macmillan Publishing Co., New York, 1977). The outer dye layer(s) also preferably aggregate and the aggregate has a maximum light absorbance at a shorter wavelength, preferably at least 5 nm shorter, than the adjacent inner dye layer(s).

In many cases the aggregation properties of a dye can be determined by coating the dye on a silver halide emulsion. The wavelength of maximum light absorbance and sensitization of the dye can be determined from the coatings by spectroscopic analysis. In some cases aggregation properties of a dye can be determined by forming a dye dispersion in aqueous gelatin. For example dye dispersions can be prepared by combining known weights of water, deionized gelatin and solid dye (e.g. 3.5% w/w gelatin, 0.1% w/w dye) into screw-capped glass vials which is then thoroughly mixed with agitation at 60° C.–80° C. for 1–2 hours. After cooling the wavelength of maximum light absorbance of the dye can be determined from the dispersions by spectroscopic analysis.

In one preferred embodiment of the invention the silver halide emulsion is dyed with a saturation or near saturation monolayer of one or more cyanine dyes which have at least one negatively charged substituent. The area a dye covers on the silver halide surface can be determined by preparing a dye concentration series, and choosing the dye level for optimum performance or by well-known techniques such as dye adsorption isotherms (for example see W. West, B. H. Carroll, and D. H. Whitcomb, J. Phys. Chem, 56, 1054 (1962)). The second layer comprises at least one dye that has at least one positively charged substituent. In another preferred embodiment a third dye is added having at least one anionic substituent and the second layer comprises a combination of dyes with at with at least one cationic substituent and dyes with at least one anionic substituent.

We have found that blue dyes in particular are easily attracted by other chemical species in the emulsion with affinity to blue dye molecules, which can ultimately result in the disruption of the dye layers. The net effect of these undesirable competitive interactions is decreased light absorption and reduced speed. We have now found that certain dye structures provide the desired enhanced light absorption in a color photographic element, including photographic elements that contain an anionic surfactant in the coupler dispersion.

In one preferred embodiment a silver halide photographic material comprising at least one silver halide emulsion comprising silver halide grains having associated therewith a combination of two or more dyes wherein at least one dye containing at least one anionic substituent and at least one dye containing at least one cationic substituent are present, wherein at least one of the dyes is further substituted with at least one hydrogen bonding donor substituent. In another preferred embodiment, at least one of the dyes is further substituted with at least two hydrogen bonding donor substituents.

In another preferred embodiment a silver halide color photographic material in which silver halide grains sensitized with at least one dye containing at least one guanidinium or amidinium substituent provides increased light absorption. In another preferred embodiment a silver halide color photographic material in which silver halide grains sensitized with at least one dye containing at least two guanidinium or amidinium substituents provides increased light absorption.

In one preferred embodiment, a molecule containing a group that strongly bonds to silver halide, such as a mercapto group (or a molecule that forms a mercapto group under alkaline or acidic conditions) or a thiocarbonyl group is added after the first dye layer has been formed and before the second dye layer is formed. Mercapto compounds represented by the following formula (A) are particularly preferred.

A

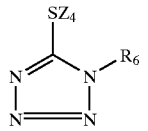

wherein $R_6$ represents an alkyl group, an alkenyl group or an aryl group and $Z_4$ represents a hydrogen atom, an alkali metal atom, an ammonium group or a protecting group that can be removed under alkaline or acidic conditions.

Examples of some preferred mercapto compounds are shown below.

A-1

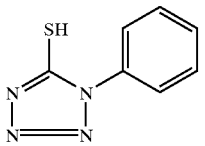

A-2

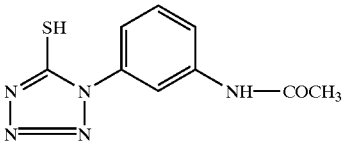

-continued

A-3

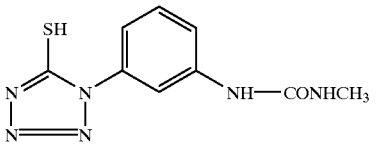

A-4

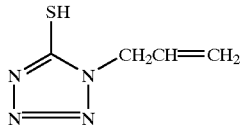

A-5

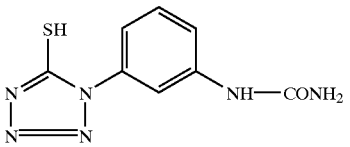

In describing preferred embodiments of the invention, one dye layer is described as an inner layer and one dye layer is described as an outer layer. It is to be understood that one or more intermediate dye layers may be present between the inner and outer dye layers, in which all of the layers are held together by non-covalent forces, as discussed in more detail above. Further, the dye layers need not completely encompass the silver halide grains or underlying dye layer(s). Also some mixing of the dyes between layers is possible.

The dyes of the inner dye layer are preferably any dyes capable of spectral sensitization, for example, a cyanine dye, merocyanine dye, complex cyanine dye, complex merocyanine dye, homopolar cyanine dye, or hemicyanine dye, etc. Of these dyes, merocyanine dyes containing a thiocarbonyl group and cyanine dyes are particularly useful. Of these cyanine dyes are especially useful. Particularly preferred is a cyanine dye of Formula Ia or a merocyanine dye of Formula Ib.

(Ia)

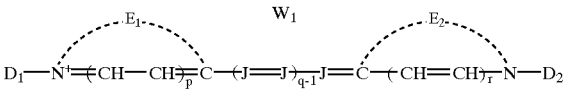

wherein:

$E_1$ and $E_2$ may be the same or different, and represent the atoms necessary to form a substituted or unsubstituted heterocyclic ring which is a basic nucleus (see *The Theory of the Photographic Process*, 4th edition, T. H. James, editor, Macmillan Publishing Co., New York, 1977 for a definition of basic and acidic nucleus);

each J independently represents a substituted or unsubstituted methine group;

q is a positive integer of from 1 to 4;

p and r each independently represents 0 or 1;

$D_1$ and $D_2$ each independently represents substituted or unsubstituted alkyl or substituted or unsubstituted aryl and at least one of $D_1$ and $D_2$ contains an anionic substituent; and $W_2$ is one or more a counterions as necessary to balance the charge;

(Ib)

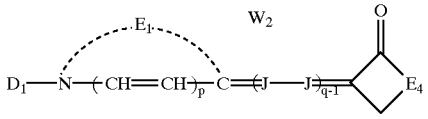

wherein $E_1$, $D_1$, J, p, q and $W_2$ are as defined above for formula (Ia) wherein $E_4$ represents the atoms necessary to complete a substituted or unsubstituted heterocyclic acidic nucleus which preferably contains a thiocarbonyl group.

The dyes of the outer dye layer are not necessarily spectral sensitizers. Examples of preferred outer layer dyes are a cyanine dye, merocyanine dye, arylidene dye, complex cyanine dye, complex merocyanine dye, homopolar cyanine dye, hemicyanine dye, styryl dye, hemioxonol dye, oxonol dye, anthraquinone dye, triphenylmethane dye, azo dye type, azomethines, coumarin dye or combinations of dyes from these classes. Particularly preferred are dyes having structure IIa, IIb, and IIc, (IIa)

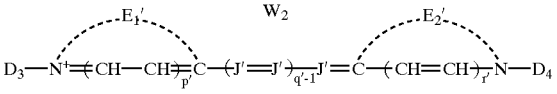

wherein:

$E_1'$ and $E_2'$ may be the same or different and represent the atoms necessary to form a substituted or unsubstituted heterocyclic ring which is a basic nucleus, with the proviso that $E_1'$ and $E_2'$ of formula IIa are not the same as $E_1$ and $E_2$ of formula (Ia);

each J' independently represents a substituted or unsubstituted methine group;

q' is a positive integer of from 1 to 4;

p' and r' each independently represents 0 or 1;

$D_3$ and $D_4$ each independently represents substituted or unsubstituted alkyl or substituted or unsubstituted aryl and at least one of $E_1'$, $E_2'$, J' or $D_3$ and $D_4$ contains a cationic substituent;

$W_2$ is one or more a counterions as necessary to balance the charge;

(IIb)

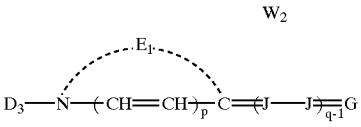

wherein $E_1$, $D_3$, J, p, q and $W_2$ are as defined above for Formula (I) and G represents

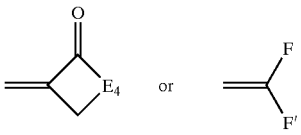

wherein $E_4$ represents the atoms necessary to complete a substituted or unsubstituted heterocyclic acidic nucleus, and F and F' each independently represents a cyano radical, an ester radical, an acyl radical, a carbamoyl radical or an alkylsulfonyl radical, and at least one of $E_1$, G, J or $D_3$ contains a cationic substituent, (IIc)

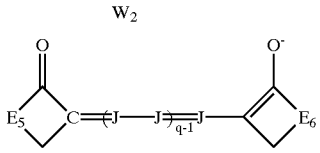

wherein J and $W_2$ are as defined above for Formula (I) above and q is 2,3 or 4, and $E_5$ and $E_6$ independently represent the atoms necessary to complete a substituted or unsubstituted acidic heterocyclic nucleus and at least one of J, $E_5$, or $E_6$ contains a cationic substituent.

In embodiments of the invention in which the inner dye is of formula (Ia) and the outer dye is of formula (IIa), if either $D_1$ or $D_2$ contains an aromatic or heteroaromatic group then $D_3$ and $D_4$ do not contain an aromatic or heteroaromatic group.

$E_1$, $E_2$, $E_1'$ and $E_2'$ of formulas Ia and IIa independently represent the atoms necessary to form a substituted or unsubstituted heterocyclic ring which is a basic nucleus. These include a substituted or unsubstituted: thiazole nucleus, oxazole nucleus, selenazole nucleus, quinoline nucleus, tellurazole nucleus, pyridine nucleus, thiazoline nucleus, indoline nucleus, oxadiazole nucleus, thiadiazole nucleus, or imidazole nucleus. This nucleus may be substituted with known substituents, such as halogen (e.g., chloro, fluoro, bromo), alkoxy (e.g., methoxy, ethoxy), substituted or unsubstituted alkyl (e.g., methyl, trifluoromethyl), substituted or unsubstituted aryl, substituted or unsubstituted aralkyl, sulfonate, and others known in the art. Examples of useful nuclei include: a thiazole nucleus, e.g., thiazole, 4-methylthiazole, 4-phenylthiazole, 5-methylthiazole, 5-phenylthiazole, 4,5-dimethyl-thiazole, 4,5-diphenylthiazole, 4-(2-thienyl)thiazole, benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-phenylbenzothiazole, 6-phenylbenzothiazole, 4-methoxybenzothiazole, 5methoxybenzothiazole, 6-methoxybenzothiazole, 4-ethoxybenzothiazole, 5-ethoxybenzothiazole, tetrahydrobenzothiazole, 5,6-dimethoxybenzothiazole, 5,6-dioxymethylbenzothiazole, 5-hydroxybenzothiazole, 6-ethoxy-5-hydroxybenzothiazole, naphtho[2,1-d]thiazole, 5-ethoxynaphtho[2,3-d]thiazole, 8-methoxynaphtho[2,3-d]thiazole, 7-methoxynaphtho[2,3-d]thiazole, 4'-methoxythianaphtheno-7',6'-4,5-thiazole, etc.; an oxazole nucleus, e.g., 4-methyloxazole, 5-methyloxazole, 4-phenyloxazole, 4,5-diphenyloxazole, 4-ethyloxazole, 4,5-dimethyloxazole, 5-phenyloxazole, benzoxazole, 5-chlorobenzoxazole, 5-methylbenzoxazole, 5-phenylbenzoxazole, 6-methylbenzoxazole, 5,6-dimethylbenzoxazole, 4,6-dimethylbenzoxazole, 5-ethoxybenzoxazole, 5-chlorobenzoxazole, 6-methoxybenzoxazole, 5-hydroxybenzoxazole, 6hydroxybenzoxazole, naphtho[2,1-d]oxazole, naphtho[1,2-d]oxazole, etc.; a selenazole nucleus, e.g., 4-methylselenazole, 4-phenylselenazole, benzoselenazole, 5-chlorobenzoselenazole, 5-methoxybenzoselenazole, 5-hydroxybenzoselenazole, tetrahydrobenzoselenazole, naphtho[2,1-d]selenazole, naphtho[1,2-d]selenazole, etc.; a pyridine nucleus, e.g., 2-pyridine, 5-methyl-2-pyridine, 4pyridine, 3-methyl-4-pyridine, 3-methyl-4-pyridine, etc.; a quinoline nucleus, e.g., 2-quinoline, 3-methyl-2-quinoline, 5-ethyl-2-quinoline, 6-chloro-2-quinoline, 8-chloro-2-quinoline, 6-methoxy-2-quinoline, 8-ethoxy-2-quinoline, 8-hydroxy-2-quinoline, 4-quinoline, 6-methoxy-4-quinoline, 7methyl-4-quinoline, 8-chloro-4-quinoline, etc.; a tellurazole nucleus, e.g., benzotellurazole, naphtho[1,2-d] benzotellurazole, 5,6-dimethoxybenzotellurazole, 5-methoxybenzotellurazole, 5-methylbenzotellurazole; a thiazoline nucleus, e.g.,thiazoline, 4-methylthiazoline, etc.; a benzimidazole nucleus, e.g., benzimidazole, 5-trifluoromethylbenzimidazole, 5,6-dichlorobenzimidazole; and indole nucleus, 3,3-dimethylindole, 3,3-diethylindole, 3,3,5trimethylindole; or a diazole nucleus, e.g., 5-phenyl-1,3,4oxadiazole, and 5-methyl-1,3,4-thiadiazole.

Preferably $E_1$ and $E_2$ of formula (Ia) are not the same as $E_1'$ and $E_2'$ of formula IIa. For example, Dye A of formula Ia and Dyes B, C, and D of formula IIa are listed below. The combination Dye A and Dye B is not preferred because $E_1$ and $E_2$ in Dye A are the same as $E_1'$ and $E_2'$ in Dye B. The combination of Dye A and Dye C or Dye A and Dye D is preferred because $E_1$ and $E_2$ in Dye A are not the same as $E_1'$ and $E_2'$ in Dye C or Dye D.

Ic

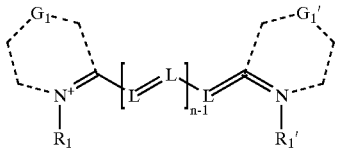

IId

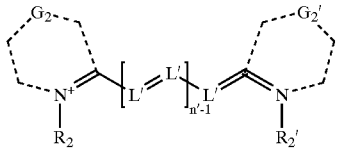

wherein:

$G_1$ and $G_1'$ independently represent the atoms necessary to complete a benzothiazole nucleus, benzoxazole nucleus, benzoselenazole nucleus, benzotellurazole nucleus, quinoline nucleus, or benzimidazole nucleus in which $G_1$ and $G_1'$ independently may be substituted or unsubstituted;

$G_2$ and $G_2'$ independently represent the atoms necessary to complete a benzothiazole nucleus, benzoxazole nucleus, benzoselenazole nucleus, benzotellurazole nucleus, quinoline nucleus, indole nucleus, or benzimidazole nucleus in which $G_2$, and $G_2'$ independently may be substituted or unsubstituted, with the proviso that $G_2$, and $G_2'$ of formula IId are not the same as $G_1$ and $G_1'$ of formula Ic;

Dye A

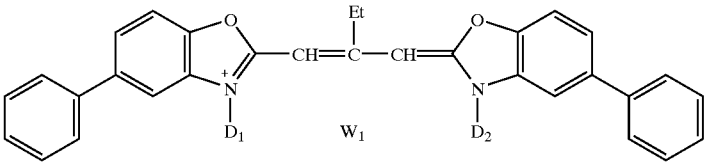

Dye B

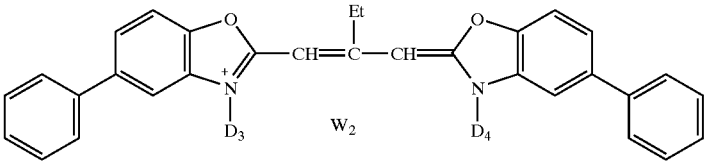

Dye C

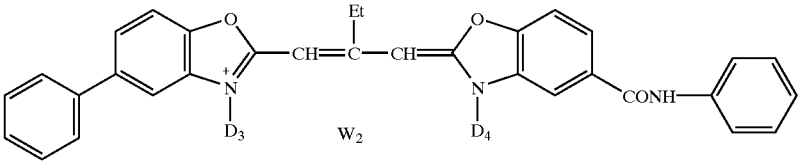

Dye D

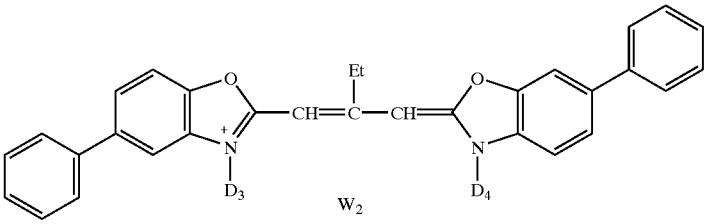

One preferred embodiment is a photographic material in which the inner dye layer comprises a cyanine dye of formula (Ic) and the outer dye layer comprises a dye of formula (IId):

n and n' are independently a positive integer from 1 to 4;

each L and L' independently represent a substituted or unsubstituted methine group;

$R_1$ and $R_1'$ each independently represents substituted or unsubstituted aryl or substituted or unsubstituted aliphatic group, at least one of $R_1$ and $R_1'$ has a negative charge;

$W_1$ is a cationic counterion to balance the charge if necessary;

$R_2$ and $R_2'$ each independently represents substituted or unsubstituted aryl or substituted or unsubstituted aliphatic group and preferably at least one of $R_2$ and $R_2'$ has a positive charge; such that the net charge of IId is +1,+2,+3,+4, or +5;

$W_2$ is one or more anionic counterions to balance the charge.

In some cases dyes can be used either at the primary sensitizer or as an antenna dye depending on the nature of the other dyes used in the dye combination. Examples of such dyes are given below.

In one preferred embodiment at least one dye of formula I is present

I

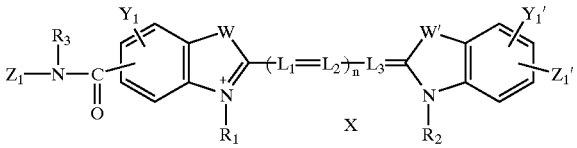

wherein:

W and W' represent independently an O atom, a S atom, a Se atom or a NR' group wherein R' is a substituted or unsubstituted alkyl group;

$Z_1$ represents a substituted or unsubstituted aromatic group;

$Z_1'$ independently represents a substituted or unsubstituted aromatic group which may be appended directly to the dye or $Z_1'$ represents $LZ_2$ where L represents a linking group and $Z_2$ represents a substituted or unsubstituted aromatic group or substituted or unsubstituted alkyl group;

$L_1$, $L_2$, and $L_3$ independently represent methine groups bearing a hydrogen, substituted or unsubstituted alkyl group, or a halogen atom;

n represents 0 or 1;

$Y_1$ and $Y_1'$ independently represent hydrogen, substituted or unsubstituted alkyl group, a substituted or unsubstituted aromatic group, a halogen atom, an acylamino group, a carbamoyl group, a carboxy group, or a substituted or unsubstituted alkoxy group;

$R_1$ and $R_2$ are both substituted or unsubstituted alkyl groups and at least one of $R_1$ or $R_2$ is substituted with a positively charged substituent, or at least one of $R_1$ or $R_2$ is substituted with a negatively charged substituent;

$R_3$ is hydrogen or a substituted or unsubstituted alkyl group;

X is one or more ions as needed to balance the charge on the molecule.

In another preferred embodiment at least one dye of formula II is present

II

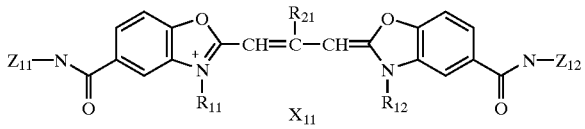

wherein:

$Z_{11}$ and $Z_{12}$ independently represents a substituted or unsubstituted aromatic group;

$R_{21}$ is H or a substituted or unsubstituted lower alkyl group or a substituted or unsubstituted aryl group;

$R_{11}$ and $R_{12}$ independently represent substituted or unsubstituted alkyl group and at least one of $R_{11}$ and $R_{12}$ is substituted with a positively charged substituent, or at least one of $R_{11}$ and $R_{12}$ is substituted with a negatively charged substituent;

$X_{11}$ is one or more ions as needed to balance the charge on the molecule.

In another preferred embodiment at least one dye of formula III is present

III

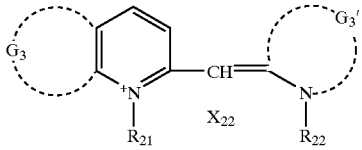

wherein:

$R_{21}$ and $R_{22}$ each independently represent substituted or unsubstituted alkyl group and at least one of $R_{21}$ and $R_{22}$ is substituted with a positively charged substituent or at least one of $R_{21}$ and $R_{22}$ is substituted with a negatively charged substituent;

$G_3$ represents represent the atoms necessary to complete a substituted or unsubstituted benzene which may contain fused aromatic rings;

$G_3'$ represents the atoms necessary to complete a substituted or unsubstituted benzothiazole, benzoselenazole or a benzoxazole nucleus which may contain fused aromatic rings;

$X_{22}$ is one or more ions as needed to balance the charge on the molecule.

In another preferred embodiment at least one dye of formula IV is present

IV

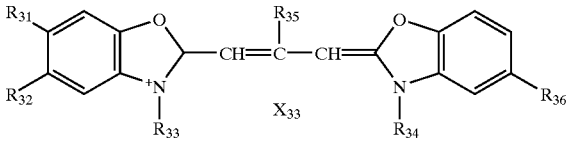

wherein:

$R_{31}$ and $R_{32}$ may be the same or different, and represent hydrogen atoms, unsubstituted or substituted alkyl groups, unsubstituted or substituted aryl groups, unsubstituted or substituted aryloxy groups, halogen atoms, unsubstituted or substituted alkoxycarbonyl groups, unsubstituted or substituted acylamino groups, unsubstituted or substituted acyl groups, cyano groups, unsubstituted or substituted carbamoyl groups, unsubstituted or substituted sulfamoyl groups, carboxyl groups, or unsubstituted or substituted acyloxy groups, provided that $R_{31}$ and $R_{32}$ do not represent hydrogen atoms at the same time;

$R_{35}$ represents a hydrogen atom, an unsubstituted or substituted alkyl group, or an unsubstituted or substituted aryl group;

$R_{36}$ represents a branched butyl, branched pentyl, branched hexyl, cyclohexyl, branched octyl, benzyl or phenethyl group, and moreover $R_{36}$ is required to be a substituent having such L and B that S value is 544 or less in the equation of $$S=3.536L-2.661B+535.4$$

wherein L represents a STERIMOL parameter (in angstrom) and B represents the smaller value among $B_1+B_4$ and $B_2+B_3$ which are each sums of STERIMOL parameters (L, $B_1$, $B_2$, $B_3$, and $B_4$ represent five dimensions, in angstroms, that describe the steric properties of a substituent, see A. Verloop et. al., *Drug Design,* 1976, J. Ariens, editor, Academic Press, New York);

$X_{33}$ represents a counter anion if necessary;

$R_{33}$ and $R_{34}$ independently represent substituted or unsubstituted alkyl groups and at least one of $R_{33}$ and $R_{34}$ is substituted with a positively charged substituent or at least one of $R_{33}$ and $R_{34}$ is substituted with a negatively charged substituent.

In another preferred embodiment at least one dye of formula V is present

V

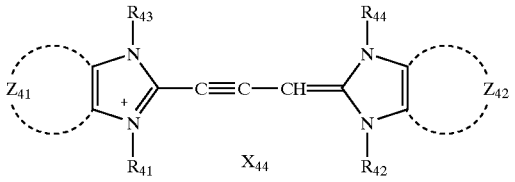

wherein:

$R_{41}$ and $R_{42}$ each represents independently a substituted or unsubstituted alkyl group and at least one of $R_{41}$ and $R_{42}$ is substituted with a positively charged substituent or at least one of $R_{41}$ and $R_{42}$ is substituted with a negatively charged substituent;

$Z_{41}$ and $Z_{42}$ independently represent the atoms necessary to complete a substituted or unsubstituted benzene ring which may contain fused aromatic rings;

$X_{44}$ is one or more ions as needed to balance the charge on the molecule.

In another preferred embodiment at least one dye of formula VI is present

VI

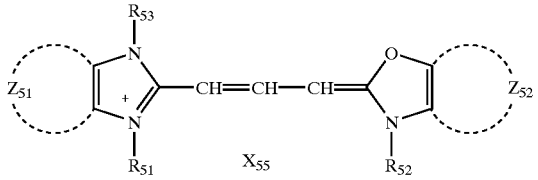

wherein:

$R_{51}$ and $R_{52}$ each represents independently a substituted or unsubstituted alkyl group and at least one of $R_{51}$ and $R_{52}$ is substituted with a positively charged substituent, or at least one of $R_{51}$ and $R_{52}$ is substituted with a negatively charged substituent;

$Z_{51}$ and $Z_{52}$ independently represent the atoms necessary to complete a substituted or unsubstituted benzene ring which may contain fused aromatic rings;

$X_{55}$ is one or more ions as needed to balance the charge on the molecule.

In another preferred embodiment at least one dye of formula VII is present

VII

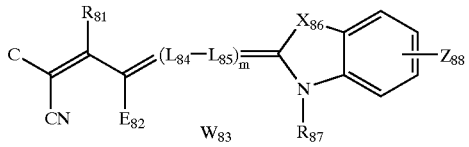

wherein:

$X_{86}$ independently represent S, Se, O, N—R', or C(Ra, Rb), wherein Ra and Rb independently represent substituted or unsubstituted alkyl groups;

$E_{82}$ represents an electron-withdrawing group;

$R_{81}$ represents a substituted or unsubstituted aromatic or heteroaromatic group;

$R_{87}$ represents a substituted or unsubstituted alkyl group;

$L_{84}$, $L_{85}$ independently represents a substituted or unsubstituted methine group;

m may be 1, or 2;

$Z_{88}$ is hydrogen or one or more substituents including possible fused rings;

at least one of $R_{81}$, $L_{84}$, $L_{85}$, $Z_{88}$, $R_{87}$ contains a group with a positive charge or a group with a negative charge;

$W_{83}$ is one or more counterions as necessary to balance the charge.

In another preferred embodiment at least one dye of formula VIII is present;

VIII

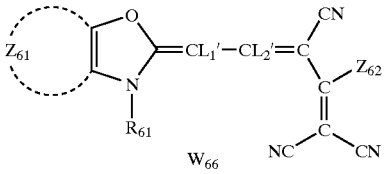

wherein:

$Z_{61}$ represent the atoms necessary to complete a substituted or unsubstituted benzene which may contain fused aromatic rings;

$Z_{62}$ represents a substituted or unsubstituted aromatic or heteroaromatic group;

$R_{61}$ represents a substituted alkyl group containing a positively charged substituent or a substituted alkyl group containing a negatively charged substituent;

$L_1'$ and $L_2'$ represents hydrogen, or substituted or unsubstituted alkyl or aryl;

$W_{66}$ is an anionic counterion.

In another preferred embodiment at least one dye of formula IX is present;

IX

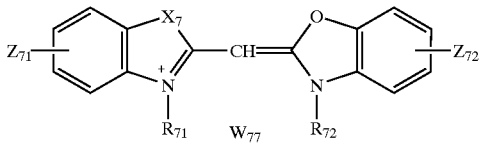

wherein:

$X_7$ represents independently O, S, $NR_{73}$, Se;

$R_{73}$, independently represents substituted or unsubstituted alkyl or substituted or unsubstituted aryl;

$R_{71}$ and $R_{72}$ each represents independently a substituted or unsubstituted alkyl group and at least one of $R_{71}$ and $R_{72}$ is substituted with a positively charged substituent or at least one of $R_{71}$ and $R_{72}$ is substituted with a negatively charged substituent;

$Z_{71}$ and $Z_{72}$, each independently represents hydrogen or one or more substituents which, optionally, may form fused aromatic rings;

$W_{77}$ represents one or more cationic counterions if necessary.

In another preferred embodiment at least one dye of formula IX substituted with at least one hydrogen bonding group.

In another preferred embodiment at least one dye of formula IX substituted with formula X

X

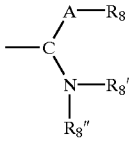

wherein:

$R_8$, $R_8'$, and $R_8''$ independently represent hydrogen or substituted or unsubstituted alkyl or substituted or unsubstituted aryl or a heteroatom (e.g., O, S, or N), and at least one of $R_8$, $R_8'$, or $R_8''$ independently represent hydrogen;

A independently represent N—$R_g$, O, or S;

$R_9$ independently represent hydrogen or substituted or unsubstituted alkyl or substituted or unsubstituted aryl;

$R_8$, $R_8'$, $R_8''$ and $R_9$ optionally may be part of one or more cyclic rings;

C atom in formula X may be connected to N or A or it's neighboring atom with either a single or a double bond.

In another preferred embodiment at least one dye of formula IX is present and wherein both $R_{71}$ or $R_{72}$ are substituted with guanidinium group, which could in turn be substituted or unsubstituted.

In a preferred embodiment the silver halide emulsion is dyed with a saturation or near saturation monolayer of one or more dyes wherein at least one dye is a cyanine dye with an anionic substituent. The second layer comprises one or more dyes wherein at least one dye has a substituent that contains a positive charge. In another preferred embodiment the second layer comprises at least one cyanine dye with at least one substituent that contains a positive charge. In one preferred embodiment the substituent that contains positive charges is connected to the cyanine dye via the nitrogen atoms of the cyanine dye chromophore. However, preferably the anionic and cationic dyes of the invention do not both have an aromatic or heteroaromatic group attached to the dye by means of the nitrogen atoms of the cyanine chromophore.

Examples of positively charged substituents are 3-(trimethylammonio)propyl), 3-(4-ammoniobutyl), 3-(4-guanidinobutyl) etc. Other examples are any substitutents that take on a positive charge in the silver halide emulsion melt, for example, by protonation such as aminoalkyl substitutents, e.g. 3-(3-aminopropyl), 3-(3-dimethylaminopropyl), 4-(4-methylaminopropyl), etc. Examples of negatively charged substituents are 3-sulfopropyl, 2-carboxyethyl, 4-sulfobutyl, etc.

The dyes of the invention can be synthesized by well-known methods. For example, (3-Bromopropyl) trimethylammonium bromide was obtained from Aldrich Chemical Company. The bromide salt was converted to the hexafluorophosphate salt to improve the compounds solubility in valeronitrile. Reaction of a heterocyclic base with 3-(bromopropyl)trimethylammonium hexafluorophosphate in valeronitrile gave the corresponding quaternary salt. For example, reaction of 2-methyl-5-phenylbenzoxazole with 3-(bromopropyl)trimethylammonium hexafluorophosphate gave 2-methyl-5-phenyl-3-(3-(trimethylammonio)propyl) benzoxazolium bromide hexafluorophosphate. Dyes were prepared from quaternary salt intermediates by standard methods such as described in F. M. Hamer, *Cyanine Dyes and Related Compounds,* 1964 (publisher John Wiley & Sons, New York, N.Y.) and *The Theory of the Photographic Process*, $4^{th}$ edition, T. H. James, editor, Macmillan Publishing Co., New York, 1977.

When reference in this application is made to a particular moiety as a "group", this means that the moiety may itself be unsubstituted or substituted with one or more substituents (up to the maximum possible number). For example, "alkyl group" refers to a substituted or unsubstituted alkyl, while "benzene group" refers to a substituted or unsubstituted benzene (with up to six substituents). Generally, unless otherwise specifically stated, substituent groups usable on molecules herein include any groups, whether substituted or unsubstituted, which do not destroy properties necessary for the photographic utility. Examples of substituents on any of the mentioned groups can include known substituents, such as: halogen, for example, chloro, fluoro, bromo, iodo; alkoxy, particularly those "lower alkyl" (that is, with 1 to 6 carbon atoms, for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as any of those described below; and others known in the art. Alkyl substituents may specifically include "lower alkyl" (that is, having I-6 carbon atoms), for example, methyl, ethyl, and the like. Further, with regard to any alkyl group or alkylene group, it will be understood that these can be branched or unbranched and include ring structures.

Particularly preferred dyes for use in accordance with this invention are given in Table I, however the dyes useful in the invention are not limited to these compounds. Examples of dyes valuable for primary sensitizers are of formula I in the Table. Dyes of formula II or III can sometimes also be used as primary sensitizers. Examples of dyes useful as antenna dyes are of formula II in the Table. As discussed previously, it is sometimes valuable to add a third dye having an anionic substituent to aid in the stabilization of the antenna dye layer. Examples of these types of dyes are designated by formula III in the Table I. Dyes of formula I can sometimes also be added as a third dye to aid in the stabilization of the antenna dye layer.

TABLE I

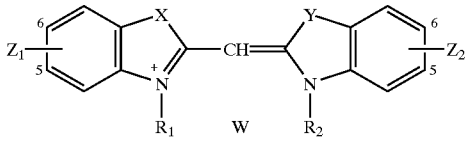

| Dye | $Z_1$ | $Z_2$ | X,Y | $R_1$ | $R_2$ | W |
|---|---|---|---|---|---|---|
| I-1 | 5-Cl | 5-Cl | S,S | $(CH_2)_3SO_3^-$ | $(CH_2)_3SO_3^-$ | $TEAH^+$ |
| I-2 | 5- 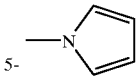 | 5-Cl | S,S | $(CH_2)_3SO_3^-$ | $(CH_2)_3SO_3^-$ | $TEAH^+$ |
| I-3 | 4,5-Benzo | 5-Cl | S,S | $(CH_2)_3SO_3^-$ | $(CH_2)_3SO_3^-$ | $TEAH^+$ |

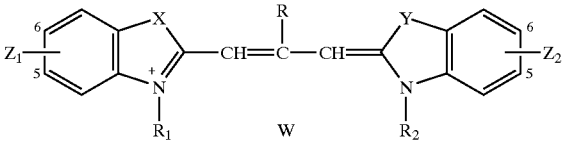

| Dye | $Z_1$ | $Z_2$ | X,Y | R | $R_1$ | $R_2$ | W |
|---|---|---|---|---|---|---|---|
| I-4 | 5-Ph | 5-Cl | O,O | Et | $—(CH_2)_2CH(CH_3)SO_3^-$ | $—(CH_2)_3SO_3^-$ | $TEAH^+$ |
| I-5 | 5-Ph | H | O,S | Et | $—C_2H_5$ | $—CH_2CONSO_2Me^-$ | — |
| I-6 | 5-Ph | 5-Ph | O,O | Et | $—(CH_2)_2CH(CH_3)SO_3^-$ | $—(CH_2)_2CH(CH_3)SO_3^-$ | $TEAH^+$ |
| I-7 | 5-Ph | 5-Ph | O,O | Et | $—(CH_2)_2SO_3^-$ | $—(CH_2)_2SO_3^-$ | $TEAH^+$ |
| I-8 | 5-Cl | 5-Cl | S,S | Et | $—(CH_2)_3SO_3^-$ | $—(CH_2)_3SO_3^-$ | $TEAH^+$ |
| I-9 | 5-Ph | 5-Cl | O,S | Et | $—(CH_2)_2CH(CH_3)SO_3^-$ | $—(CH_2)_3SO_3^-$ | $TEAH^+$ |
| I-10 | 5-Ph | H | O,S | | $—(CH_2)_3SO_3^-$ | $—CH_2CONSO_2Me^-$ | $TEAH^+$ |

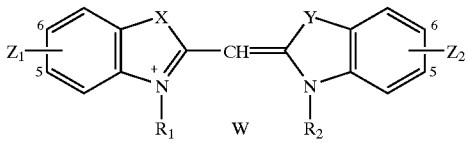

| Dye | $Z_1$ | $Z_2$ | X,Y | $R_1$ | $R_2$ | W |
|---|---|---|---|---|---|---|
| II-1 | 5-Ph | 5-Ph | S,O | 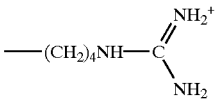 | 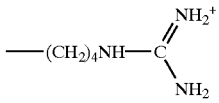 | $3Cl^-$ |
| II-2 | 5-Cl | 5-Ph | S,O | 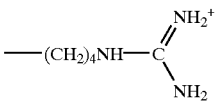 | 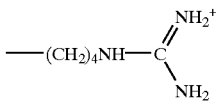 | $3Cl^-$ |
| II-3 | 5-Ph | 4,5Benzo | S,O | 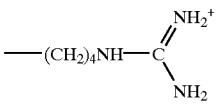 | 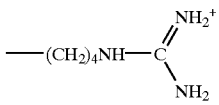 | $3Cl^-$ |

TABLE I-continued
| | | | | | | |
|---|---|---|---|---|---|---|
| II-4 | 5-Ph | 5- 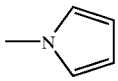 | S,O | 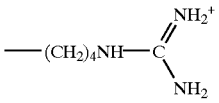 | 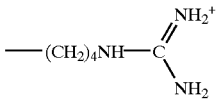 | 3Cl⁻ |
| II-5 | 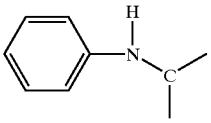 | 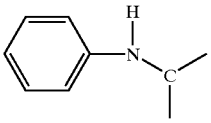 | S,S | 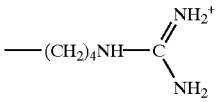 | 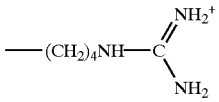 | 3Cl⁻ |
| II-6 | 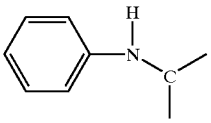 | 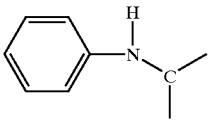 | S,O | 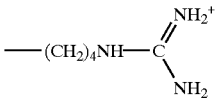 | 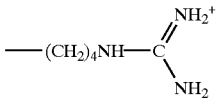 | 3Cl⁻ |
| II-7 | 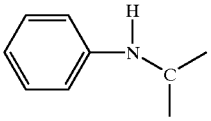 | 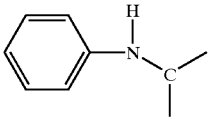 | S,S | $—(CH_2)_2O(CH_2)_2NH_3^+$ | $—(CH_2)_2O(CH_2)_2NH_3^+$ | 3Cl⁻ |
| II-8 | 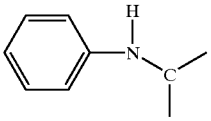 | 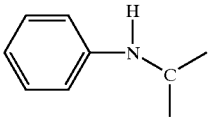 | S,S | 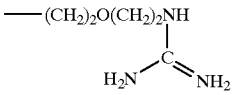 | 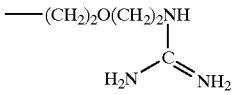 | 3Cl⁻ |
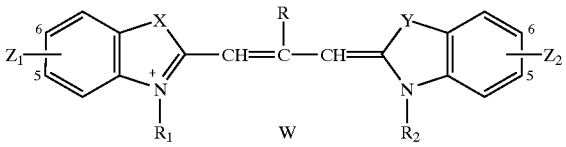
| Dye | $Z_1$ | $Z_2$ | X,Y | R | $R_1$ | $R_2$ | W |
|---|---|---|---|---|---|---|---|
| II-9 | 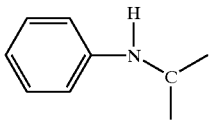 | 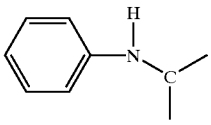 | O,O | Et | $—(CH_2)_3N(Me)_3^+$ | $—(CH_2)_3N(Me)_3^+$ | 3Br⁻ |
| II-10 | 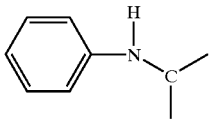 | 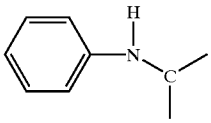 | O,O | Et | $—(CH_2)_4N(Me)_3^+$ | $—(CH_2)_3N(Me)_3^+$ | 3Br⁻ |
| II-11 | 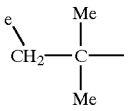 | Ph | O,O | Et | $—(CH_2)_3N(Me)_3^+$ | $—(CH_2)_3N(Me)_3^+$ | 3Br⁻ |
| II-12 | 5-Cl,6-Cl | Ph | NEt,O | H | $—(CH_2)_3N(Me)_3^+$ | $—(CH_2)_3N(Me)_3^+$ | 3Br⁻ |
| II-13 | 5-Ph | 5-Ph | O,O | Et | $—(CH_2)_3N(Me)_3^+$ | $—(CH_2)_3N(Me)_3^+$ | 3Br⁻ |

TABLE I-continued

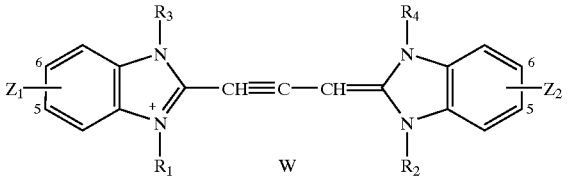

| Dye | $Z_1$ | $Z_2$ | $R_1$ | $R_2$ | $R_3$ | $R_4$ | W |
|---|---|---|---|---|---|---|---|
| II-14 | 5,6-Cl | 5,6-Cl | $—(CH_2)_3N(Me)_3^+$ | $—(CH_2)_3N(Me)_3^+$ | $—(CH_2)_2Ph$ | $—(CH_2)_2Ph$ | $3Br^-$ |
| II-15 | 5,6-Cl | 5,6-Cl | $—(CH_2)_3N(Me)_3^+$ | $—(CH_2)_3N(Me)_3^+$ | Et | Et | $3Br^-$ |
| II-16 | 5,6-Cl | 5,6-Cl | $—(CH_2)_4NH—C(=NH_2^+)NH_2$ | $—(CH_2)_4NH—C(=NH_2^+)NH_2$ | Et | Et | $3Br^-$ |

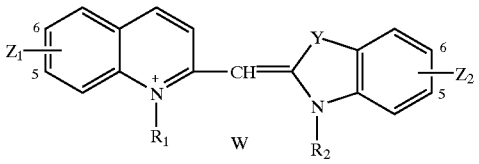

| Dye | $Z_1$ | $Z_2$ | X,Y | R | $R_1$ | $R_2$ | W |
|---|---|---|---|---|---|---|---|
| II-17 | 6-Me | 5-Ph | S | Et | $—(CH_2)_3N(Me)_3^+$ | $—(CH_2)_3N(Me)_3^+$ | $3Br^-$ |
| II-18 | 6-OMe | 5-Ph | S | Et | $—(CH_2)_3N(Me)_3^+$ | $—(CH_2)_3N(Me)_3^+$ | $3Br^-$ |
| II-19 | 6-OMe | 5-Ph | 0 | Et | $—(CH_2)_3N(Me)_3^+$ | $—(CH_2)_3N(Me)_3^+$ | $3Br^-$ |

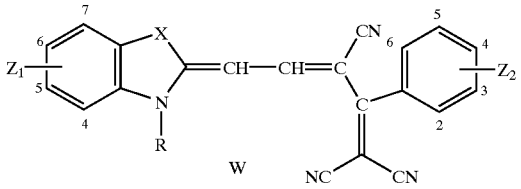

| Dye | X | R | $X_1$ | $Z_2$ | W |
|---|---|---|---|---|---|
| II-20 | O | $—(CH_2)_3N(Me)_3^+$ | 5-Ph | H | $Br^-$ |
| II-21 | O | $—(CH_2)_3N(Me)_3^+$ | 5-Ph | 4-OMe | $Br^-$ |
| II-22 | O | $—(CH_2)_3N(Me)_3^+$ | 5-Ph | H | Mesylate |
| II-23 | O | $—(CH_2)_3N(Me)_3^+$ | 5-Ph | H | Glycolate |
| II-24 | O | $—(CH_2)_3NEt(Me)_3^+$ | 5-Ph | H | Mesylate |
| II-25 | O | $—(CH_2)_3NMe(Et)_2^+$ | 5-Ph | H | Mesylate |
| II-26 | O | $—(CH_2)_3N(Et)_3^+$ | 5-Ph | H | Mesylate |
| II-27 | S | $—(CH_2)_3NMe(Et)_2^+$ | 5-Ph | H | Mesylate |

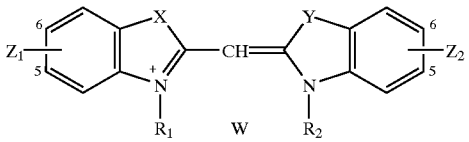

| Dye | $Z_1$ | $Z_2$ | X,Y | $R_1$ | $R_2$ | W |
|---|---|---|---|---|---|---|
| III-1 | 5-Cl | 5-Ph | S,O | $—(CH_2)_3SO_3^-$ | $—(CH_2)_3SO_3^-$ | $TEAH^+$ |
| III-2 | 5-Ph | 5-Ph | S,O | $—(CH_2)_3SO_3^-$ | $—(CH_2)_3SO_3^-$ | $TEAH^+$ |

TABLE I-continued

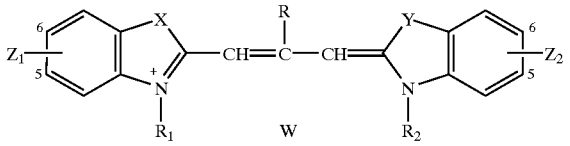

| Dye | $Z_1$ | $Z_2$ | X,Y | R | $R_1$ | $R_2$ | W |
|---|---|---|---|---|---|---|---|
| III-3 | 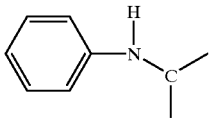 | 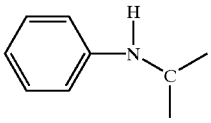 | O,O | Et | $—(CH_2)_3SO_3^-$ | $—(CH_2)_3SO_3^-$ | $TEAH^+$ |
| III-4 | 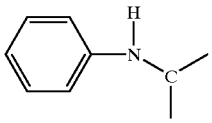 | 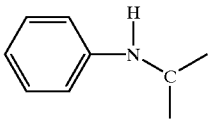 | O,O | Et | $—(CH_2)_4SO_3^-$ | $—(CH_2)_4SO_3^-$ | $TEAH^+$ |
| III-5 | 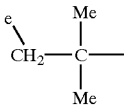 | Ph | O,O | Et | $—(CH_2)_2SO_3^-$ | $—(CH_2)_4SO_3^-$ | $TEAH^+$ |
| III-6 | 5-Cl, 6-Cl | Ph | NEt,O | H | $—(CH_2)_2SO_3^-$ | $—(CH_2)_4SO_3^-$ | $TEAH^+$ |

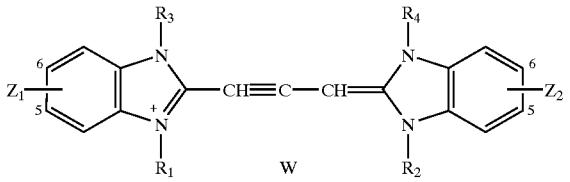

| Dye | Z | $Z_2$ | $R_1$ | $R_2$ | $R_3$ | $R_4$ | W |
|---|---|---|---|---|---|---|---|
| III-7 | 5,6-Cl | 5,6-Cl | $—(CH_2)_2SO_3^-$ | $—(CH_2)_2SO_3^-$ | Et | Et | $Na^+$ |
| III-8 | 5-$CF_3$ | 5-$CF_3$ | $—(CH_2)_3SO_3^-$ | $—(CH_2)_3SO_3^-$ | Et | Et | $Na^+$ |

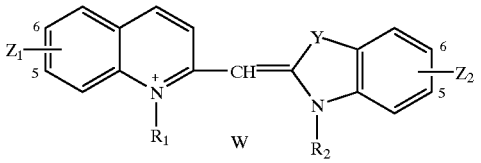

| Dye | $Z_1$ | $Z_2$ | X,Y | R | $R_1$ | $R_2$ | W |
|---|---|---|---|---|---|---|---|
| III-8 | 6-Me | 5-Ph | S | Et | $—(CH_2)_3SO_3^-$ | $—(CH_2)_3SO_3^-$ | $TEAH^+$ |
| III-9 | 6-OMe | 5-Ph | S | Et | $—(CH_2)_3SO_3^-$ | $—(CH_2)_3SO_3^-$ | $TEAH^+$ |
| III-10 | 6-OMe | 5-Ph | O | Et | $—(CH_2)_3SO_3^-$ | $—(CH_2)_3SO_3^-$ | $TEAH^+$ |

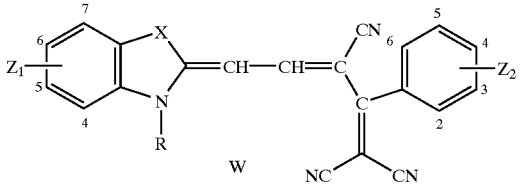

| Dye | X | R | $Z_1$ | $Z_2$ | W |
|---|---|---|---|---|---|
| III-11 | O | $—CH_2)_3SO_3^-$ | 5-Ph | H | $Na^+$ |
| III-12 | O | $—(CH_2)_2SO_3^-$ | 5-Ph | H | $Na^+$ |

The amount of sensitizing dye that is useful in the invention may be from 0.001 to 4 millimoles, but is preferably in the range of 0.01 to 4.0 millimoles per mole of silver halide and more preferably from 0.10 to 4.0 millimoles per mole of silver halide. Optimum dye concentrations can be determined by methods known in the art.

The silver halide may be sensitized by sensitizing dyes by any method known in the art, such as described in *Research Disclosure,* September 1996, Number 389, Item 38957, which will be identified hereafter by the term "Research Disclosure I." The dyes may, for example, be added as a solution or dispersion in water, alcohol, aqueous gelatin, alcoholic aqueous gelatin, microcrystalline dispersion, etc. Several dyes may be added simultaneously from a common solution or dispersion. The dye/silver halide emulsion may be mixed with a dispersion of color image-forming coupler immediately before coating or in advance of coating.

The emulsion layer of the photographic material of the invention can comprise any one or more of the light sensitive layers of the photographic material. The photographic materials made in accordance with the present invention can be black and white elements, single color elements or multicolor elements. Multicolor elements contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the visible spectrum can be disposed as a single segmented layer.

Photographic materials of the present invention may also usefully include a magnetic recording material as described in *Research Disclosure,* Item 34390, November 1992, or a transparent magnetic recording layer such as a layer containing magnetic particles on the underside of a transparent support as in U.S. Pat. Nos. 4,279,945 and 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic materials of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic material is exposed.

In the following discussion of suitable materials for use in elements of this invention, reference will be made to *Research Disclosure I.*" The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application are incorporated herein by reference.

The silver halide emulsions employed in the photographic materials of the present invention may be negative-working, such as surface-sensitive emulsions or unfogged internal latent image forming emulsions, or positive working emulsions of the internal latent image forming type (that are fogged during processing). Suitable emulsions and their preparation as well as methods of chemical and spectral sensitization are described in Sections I through V. Color materials and development modifiers are described in Sections V through XX. Vehicles which can be used in the photographic materials are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic materials of the present invention may also use colored couplers (e.g., to adjust levels of interlayer correction), and masking couplers such as those described in EP 213 490; Japanese Published Application 58-172,647; U.S. Pat. No. 2,983,608; German Application DE 2,706,117C; U.K.

Patent 1,530,272; Japanese Application A-113935; U.S. Pat. No. 4,070,191 and German Application DE 2,643,965. The masking couplers may be shifted or blocked.

The photographic materials may also contain materials that accelerate or otherwise modify the processing steps of bleaching or fixing to improve the quality of the image. Bleach accelerators described in EP 193 389; EP 301 477; U.S. Pat. Nos. 4,163,669; 4,865,956; and 4,923,784 are particularly useful. Also contemplated is the use of nucleating agents, development accelerators or their precursors (UK Patent 2,097,140; U.K. Patent 2,131,188); development inhibitors and their precursors (U.S. Pat. Nos. 5,460,932; 5,478,711); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. Nos. 4,420,556; and 4,543,323.) Also, the couplers may be blocked or coated in protected form as described, for example, in Japanese Application 61/258,249 or U.S. Pat. No. 5,019,492.

The photographic materials may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference.

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. Nos. 4,346,165; 4,540,653 and 4,906,559); with ballasted chelating agents such as those in U.S. Pat. No. 4,994,359 to reduce sensitivity to polyvalent cations such as calcium; and with stain reducing compounds such as described in U.S. Pat. Nos. 5,068,171 and 5,096,805. Other compounds which may be useful in the elements of the invention are disclosed in Japanese Published Applications 83-09,959; 83-62,586; 90-072,629; 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic materials may be silver iodobromide, silver bromide, silver chloride, silver chlorobromide, silver chloroiodobromide, and the like.

The type of silver halide grains preferably include polymorphic, cubic, and octahedral. The grain size of the silver halide may have any distribution known to be useful in photographic compositions, and may be either polydispersed or monodispersed. Tabular grain silver halide emulsions may also be used.

Tabular grains are silver halide grains having parallel major faces and an aspect ratio of at least 2, where aspect ratio is the ratio of grain equivalent circular diameter (ECD) divided by grain thickness (t). The equivalent circular diameter of a grain is the diameter of a circle having an area equal to the projected area of the grain. A tabular grain emulsion is one in which tabular grains account for greater than 50 percent of total grain projected area. In preferred tabular grain emulsions tabular grains account for at least 70 percent of total grain projected area and optimally at least 90 percent of total grain projected area. It is possible to prepare tabular grain emulsions in which substantially all (>97%) of the grain projected area is accounted for by tabular grains. The non-tabular grains in a tabular grain emulsion can take any convenient conventional form. When coprecipitated with the tabular grains, the non-tabular grains typically exhibit the same silver halide composition as the tabular grains.

The tabular grain emulsions can be either high bromide or high chloride emulsions. High bromide emulsions are those in which silver bromide accounts for greater than 50 mole percent of total halide, based on silver. High chloride emulsions are those in which silver chloride accounts for greater than 50 mole percent of total halide, based on silver. Silver bromide and silver chloride both form a face centered cubic crystal lattice structure. This silver halide crystal lattice structure can accommodate all proportions of bromide and chloride ranging from silver bromide with no chloride present to silver chloride with no bromide present. Thus, silver bromide, silver chloride, silver bromochloride and silver chlorobromide tabular grain emulsions are all specifically contemplated. In naming grains and emulsions containing two or more halides, the halides are named in order of ascending concentrations. Usually high chloride and high bromide grains that contain bromide or chloride, respectively, contain the lower level halide in a more or less uniform distribution. However, non-uniform distributions of chloride and bromide are known, as illustrated by Maskasky U.S. Pat. Nos. 5,508,160 and 5,512,427 and Delton U.S. Pat. Nos. 5,372,927 and 5,460,934, the disclosures of which are here incorporated by reference.

It is recognized that the tabular grains can accommodate iodide up to its solubility limit in the face centered cubic crystal lattice structure of the grains. The solubility limit of iodide in a silver bromide crystal lattice structure is approximately 40 mole percent, based on silver. The solubility limit of iodide in a silver chloride crystal lattice structure is approximately 11 mole percent, based on silver. The exact limits of iodide incorporation can be somewhat higher or lower, depending upon the specific technique employed for silver halide grain preparation. In practice, useful photographic performance advantages can be realized with iodide concentrations as low as 0.1 mole percent, based on silver. It is usually preferred to incorporate at least 0.5 (optimally at least 1.0) mole percent iodide, based on silver. Only low levels of iodide are required to realize significant emulsion speed increases. Higher levels of iodide are commonly incorporated to achieve other photographic effects, such as interimage effects. Overall iodide concentrations of up to 20 mole percent, based on silver, are well known, but it is generally preferred to limit iodide to 15 mole percent, more preferably 10 mole percent, or less, based on silver. Higher than needed iodide levels are generally avoided, since it is well recognized that iodide slows the rate of silver halide development.

Iodide can be uniformly or non-uniformly distributed within the tabular grains. Both uniform and non-uniform iodide concentrations are known to contribute to photographic speed. For maximum speed it is common practice to distribute iodide over a large portion of a tabular grain while increasing the local iodide concentration within a limited portion of the grain. It is also common practice to limit the concentration of iodide at the surface of the grains. Preferably the surface iodide concentration of the grains is less than 5 mole percent, based on silver. Surface iodide is the iodide that lies within 0.02 nm of the grain surface.

With iodide incorporation in the grains, the high chloride and high bromide tabular grain emulsions contemplated within the invention extend to silver iodobromide, silver iodochloride, silver iodochlorobromide and silver iodobromochloride tabular grain emulsions.

When tabular grain emulsions are spectrally sensitized, as herein contemplated, it is preferred to limit the average thickness of the tabular grains to less than 0.3 $\mu$m. Most preferably the average thickness of the tabular grains is less than 0.2 $\mu$m. In a specific preferred form the tabular grains are ultrathin—that is, their average thickness is less than 0.07 $\mu$m.

The useful average grain ECD of a tabular grain emulsion can range up to about 15 $\mu$m. Except for a very few high-speed applications, the average grain ECD of a tabular grain emulsion is conventionally less than 10 μm, with the average grain ECD for most tabular grain emulsions being less than 5 μm.

The average aspect ratio of the tabular grain emulsions can vary widely, since it is quotient of ECD divided grain thickness. Most tabular grain emulsions have average aspect ratios of greater than 5, with high (>8) average aspect ratio emulsions being generally preferred. Average aspect ratios ranging up to 50 are common, with average aspect ratios ranging up to 100 and even higher, being known.

The tabular grains can have parallel major faces that lie in either {100} or {111} crystal lattice planes. In other words, both {111} tabular grain emulsions and {100} tabular grain emulsions are within the specific contemplation of this invention. The {111} major faces of {111} tabular grains appear triangular or hexagonal in photomicrographs while the {100} major faces of {100} tabular grains appear square or rectangular.

High chloride {111} tabular grain emulsions are specifically contemplated, as illustrated by the following patents herein incorporated by reference:

Wey et al U.S. Pat. No. 4,414,306;
Maskasky U.S. Pat. No. 4,400,463;
Maskasky U.S. Pat. No. 4,713,323;
Takada et al U.S. Pat. No. 4,783,398;
Nishikawa et al U.S. Pat. No. 4,952,508;
Ishiguro et al U.S. Pat. No. 4,983,508;
Tufano et at U.S. Pat. No. 4,804,621;
Maskasky U.S. Pat. No. 5,061,617;
Maskasky U.S. Pat. No. 5,178,997;
Maskasky and Chang U.S. Pat. No. 5,178,998;
Maskasky U.S. Pat. No. 5,183,732;
Maskasky U.S. Pat. No. 5,185,239;
Maskasky U.S. Pat. No. 5,217,858; and
Chang et at. U.S. Pat. No. 5,252,452.

Since silver chloride grains are most stable in terms of crystal shape with {100} crystal faces, it is common practice to employ one or more grain growth modifiers during the formation of high chloride {111} tabular grain emulsions. Typically the grain growth modifier is displaced prior to or during subsequent spectral sensitization, as illustrated by Jones et al U.S. Pat. No. 5,176,991 and Maskasky U.S. Pat. Nos. 5,176,992, 5,221,602, 5,298,387 and 5,298,388, the disclosures of which are herein incorporated by reference.

Preferred high chloride tabular grain emulsions are {100} tabular grain emulsions, as illustrated by the following patents, herein incorporated by reference:

Maskasky U.S. Pat. No. 5,264,337;
Maskasky U.S. Pat. No. 5,292,632;
House et al U.S. Pat. No. 5,320,938;
Maskasky U.S. Pat. No. 5,275,930;
Brust et al U.S. Pat. No. 5,314,798;
Chang et al U.S. Pat. No. 5,413,904;
Budz et al U.S. Pat. No. 5,451,490;
Maskasky U.S. Pat. No. 5,607,828;
Chang et al U.S. Pat. No. 5,663,041;
Reed et al U.S. Pat. No. 5,695,922; and
Chang et al U.S. Pat. No. 5,744,297.

Since high chloride {100} tabular grains have {100} major faces and are, in most instances, entirely bounded by {100} grain faces, these grains exhibit a high degree of grain shape stability and do not require the presence of any grain growth modifier for the grains to remain in a tabular form following their precipitation.

High bromide {100} tabular grain emulsions are known, as illustrated by Mignot U.S. Pat. No. 4,386,156 and Gourlaouen et al U.S. Pat. No. 5,726,006, the disclosures of which are herein incorporated by reference. It is, however, generally preferred to employ high bromide tabular grain emulsions in the form of {111} tabular grain emulsions, as illustrated by the following patents, herein incorporated by reference:

Kofron et al U.S. Pat. No. 4,439,520;
Wilgus et al U.S. Pat. No. 4,434,226;
Solberg et al U.S. Pat. No. 4,433,048;
Maskasky U.S. Pat. No. 4,435,501;
Maskasky U.S. Pat. No. 4,463,087;
Daubendiek et al U.S. Pat. No. 4,414,310;
Daubendiek et al U.S. Pat. No. 4,672,027;
Daubendiek et al U.S. Pat. No. 4,693,964;
Maskasky U.S. Pat. No. 4,713,320;
Daubendiek et al U.S. Pat. No. 4,914,014;
Piggin et al U.S. Pat. No. 5,061,616;
Piggin et al U.S. Pat. No. 5,061,609;
Bell et al U.S. Pat. No. 5,132,203;
Antoniades et al U.S. Pat. No. 5,250,403;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Tsaur et al U.S. Pat. No. 5,252,453,
Brust U.S. Pat. No. 5,248,587;
Black et al U.S. Pat. No. 5,337,495;
Black et al U.S. Pat. No. 5,219,720;
Delton U.S. Pat. No. 5,310,644;
Chaffee et al U.S. Pat. No. 5,358,840;
Maskasky U.S. Pat. No. 5,411,851;
Maskasky U.S. Pat. No. 5,418,125;
Wen U.S. Pat. No. 5,470,698;
Mignot et al U.S. Pat. No. 5,484,697;
Olm et al U.S. Pat. No. 5,576,172;
Maskasky U.S. Pat. No. 5,492,801;
Daubendiek et al U.S. Pat. No. 5,494,789;
King et al U.S. Pat. No. 5,518,872;
Maskasky U.S. Pat. No. 5,604,085;
Reed et al U.S. Pat. No. 5,604,086;
Eshelman et al U.S. Pat. No. 5,612,175;
Eshelman et at U.S. Pat. No. 5,612,176;
Levy et al U.S. Pat. No. 5,612,177;
Eshelman et al U.S. Pat. No. 5,14,359;
Maskasky U.S. Pat. No. 5,620,840;
Irving et al U.S. Pat. No. 5,667,954;
Maskasky U.S. Pat. No. 5,667,955;
Maskasky U.S. Pat. No. 5,693,459;
Irving et al U.S. Pat. No. 5,695,923;
Reed et at U.S. Pat. No. 5,698,387;
Deaton et al U.S. Pat. No. 5,726,007;
Irving et al U.S. Pat. No. 5,728,515;
Maskasky U.S. Pat. No. 5,733,718; and
Brust U.S. Pat. No. 5,763,151.

In many of the patents listed above (starting with Kofron et al, Wilgus et al and Solberg et al, cited above) speed increases without accompanying increases in granularity are realized by the rapid (a.k.a. dump) addition of iodide for a portion of grain growth. Chang et al U.S. Pat. No. 5,314,793 correlates rapid iodide addition with crystal lattice disruptions observable by stimulated X-ray emission profiles.

Localized peripheral incorporations of higher iodide concentrations can also be created by halide conversion. By controlling the conditions of halide conversion by iodide, differences in peripheral iodide concentrations at the grain corners and elsewhere along the edges can be realized. For example, Fenton et al U.S. Pat. No. 5,476,760 discloses lower iodide concentrations at the corners of the tabular grains than elsewhere along their edges. Jagannathan et al U.S. Pat. Nos. 5,723,278 and 5,736,312 disclose halide conversion by iodide in the corner regions of tabular grains.

Crystal lattice dislocations, although seldom specifically discussed, are a common occurrence in tabular grains. For example, examinations of the earliest reported high aspect ratio tabular grain emulsions (e.g., those of Kofron et al, Wilgus et al and Solberg et al, cited above) reveal high levels of crystal lattice dislocations. Black et al U.S. Pat. No. 5,709,988 correlates the presence of peripheral crystal lattice dislocations in tabular grains with improved speed-granularity relationships. Ikeda et al U.S. Pat. No. 4,806,461 advocates employing tabular grain emulsions in which at least 50 percent of the tabular grains contain 10 or more dislocations. For improving speed-granularity characteristics, it is preferred that at least 70 percent and optimally at least 90 percent of the tabular grains contain 10 or more peripheral crystal lattice dislocations.

The silver halide grains to be used in the invention may be prepared according to methods known in the art, such as those described in *Research Disclosure I* and *The Theory of the Photographic Process*, $4^{th}$ edition, T. H. James, editor, Macmillan Publishing Co., New York, 1977. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure I*, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is herein incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure* Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure.

To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

The contrast of the photographic material can be further increased by doping the grains with a hexacoordination complex containing a nitrosyl or thionitrosyl ligand (NZ dopants) as disclosed in McDugle et al U.S. Pat. No. 4,933,272, the disclosure of which is herein incorporated by reference.

The contrast increasing dopants can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant, and an NZ dopant. For this latter three-way combination of dopants it is generally most convenient in terms of precipitation to incorporate the NZ dopant first, followed by the SET dopant, with the non-SET Ir dopant incorporated last.

The photographic materials of the present invention, as is typical, provide the silver halide in the form of an emulsion. Photographic emulsions generally include a vehicle for coating the emulsion as a layer of a photographic material. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly (vinyl alcohol), poly (vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as described in *Research Disclosure I,* Section IV (pages 510–511) and the references cited therein.

Photographic materials of the present invention are preferably imagewise exposed using any of the known techniques, including those described in *Research Disclosure I,* section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic materials comprising the composition of the invention can be processed in any of a number of well-known photographic processes utilizing any of a number of well-known processing compositions, described, for example, in *Research Disclosure I,* or in *The Theory of the Photographic Process*, 4$^{th}$ edition, T. H. James, editor, Macmillan Publishing Co., New York, 1977. In the case of processing a negative working element, the element is treated with a color developer (that is one which will form the colored image dyes with the color couplers), and then with an oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride,
4-amino-3-methyl-N,N-diethylaniline hydrochloride,
4-amino-3-methyl-N-ethyl-N-(β-(methanesulfonamido) ethylaniline sesquisulfate hydrate,
4-amino-3-methyl-N-ethyl-N-(β-hydroxyethyl)aniline sulfate,
4-amino-3-β-(methanesulfonamido)ethyl-N,N-diethylaniline hydrochloride and
4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure,* Vol. 116, December, 1973, Item 11660, and Bissonette *Research Disclosure,* Vol. 148, August, 1976, Items 14836, 14846 and 14847. The photographic materials can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et at WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development is followed by bleachfixing, to remove silver or silver halide, washing and drying.

Spectral Absorption Properties of Dyes

Light absorption properties of a dye as a J-aggregate was determined by coating the dye on a polyester support with a 3.7 mm×0.11 mm silver bromide tabular emulsion containing iodide (3.6 mol %). Details of the precipitation of this emulsion can be found in Fenton, et al., U.S. Pat. No. 5,476,760. Briefly, 3.6% KI was run after precipitation of 70% of the total silver, followed by a silver over-run to complete the precipitation. The emulsion contained 50 mppm of tetrapotassium hexacyanoruthenate ($K_4Ru(CN)_6$) added between 66 and 67% of the silver precipitation. The emulsion (0.0143 mole Ag) was heated to 40° C., the specific sensitizing dye (see Table II) was added, and the emulsion was then heated to 60° C., and held for 15'. After cooling to 40° C. gelatin (647 g/Ag mole total), and distilled water (sufficient to bring the final concentration to 0.11 Ag mmole/g of melt) were added. Single-layer coatings were made on acetate support. Total gelatin laydown was 4.8 g/m$^2$ (450 mg/ft$^2$). Silver laydown was 0.5 g/m$^2$ (50 mg/ft$^2$). The wavelength of maximum light absorption (λmax) was determined from spectroscopic measurements of the dyed coatings (Table II).

TABLE II

Wavelength of Maximum Light Absorption

| Dye | λmax (nm) |
|---|---|
| I-1 | 471 |
| I-4 | 547 |
| I-5 | 586 |
| I-6 | 544 |
| I-9 | 588 |
| I-10 | 587 |
| II-1 | 441 |
| II-4 | 445 |
| II-5 | 454 |
| II-7 | 450 |
| II-8 | 452 |
| II-9 | 527 |
| II-13 | 547 |
| II-22 | 551 |
| III-3 | 526 |
| III-4 | 527 |
| III-8 | 536 |

In a preferred embodiment, the sensitizing dye is a cyanine dye. The antenna dye may also be a cyanine dye and may have the same chromophore as the sensitizing dye. However, the substituents on the sensitizing dye and the antenna dye chromophores should be different so that the dyes aggregate and absorb light at different wavelengths. In particular, substituents on the back-ring of cyanine dye chromophores strongly affect the aggregation of these dyes. For example, the J-aggregates of dyes II-13 and dye I-6 (Table I), which have the same chromophores and back-ring substituents, have a wavelength of maximum light absorption at 547 nm and 544 nm respectively (Table II). The J-aggregate of dye II-9, which has the same chromophore as II-13 and I-6, but different back-ring substituents, has a wavelength of maximum light absorption at 527 nm (Table II). Thus, when the sensitizing dye and the antenna dye are both cyanines, they preferably have different back-ring substituents in order to obtain a broad light absorption envelope.

precipitation. The emulsion (0.0143 mole Ag) was heated to 40° C. and sodium thiocyanate (120 mg/Ag mole) was added and after a 20' hold the first sensitizing dye (dye I-6, 0.80 mmol/silver mole) was added. After an additional 20' a gold salt (bis[2,3-dihydro-1,4,5-trimethyl-3-(thioxo-κS)-1H-1,2,4-triazoliumatol]-gold, tetrafluoroborate, 2.2 mg/Ag mole), sulfur agent (N-((dimethylamino)thioxomethyl)-N-methylglycine, sodium salt, 2.3 mg/Ag mole) and an antifoggant (3-(3-((methylsulfonyl)amino)-3-oxopropyl)-benzothiazolium tetrafluoroborate), 45 mg/Ag mole) were added at 5' intervals, the melt was held for 20' and then heated to 60° C. for 20'. After cooling to 40° C. the second dye (see Table IIIa for dye and level), when present, and then a third dye (see Table IIIa for dye and level), when present, was added to the melt. After 30' at 40° C., gelatin (647 g/Ag mole total), distilled water (sufficient to bring the final concentration to 0.11 Ag mmole/g of melt) and tetrazaindine (1.0 g/Ag mole) were added.

II-13

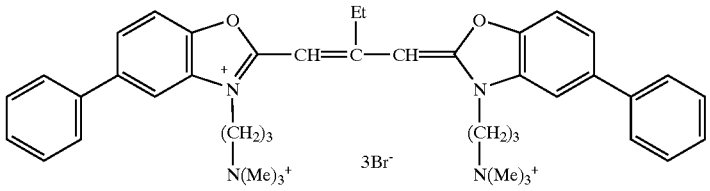

I-6

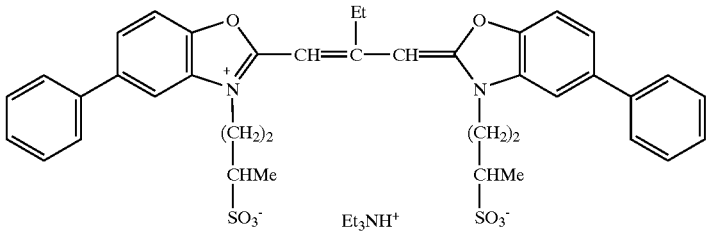

II-9

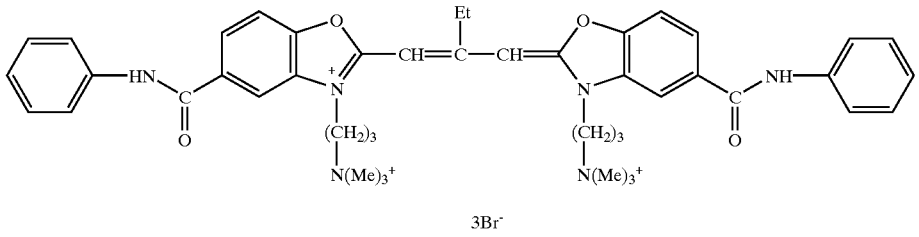

PHOTOGRAPHIC EVALUATION

EXAMPLE 1

Film coating evaluations were carried out in color format on a sulfur-and-gold sensitized 3.7 μm×0.11 μm silver bromide tabular emulsion containing iodide (3.6 mol %). Details of the precipitation of this emulsion can be found in Fenton, et al., U.S. Pat. No. 5,476,760. Briefly, 3.6% KI was run after precipitation of 70% of the total silver, followed by a silver over-run to complete the precipitation. The emulsion contained 50 mppm of tetrapotassium hexacyanoruthenate ($K_4Ru(CN)_6$) added between 66 and 67% of the silver Single-layer coatings were made on acetate support. Total gelatin laydown was 4.8 g/m$^2$ (450 mg/ft$^2$). Silver laydown was 0.5 g/m$^2$ (50 mg/ft$^2$). The emulsion was combined with a coupler dispersion containing C-1 just prior to coating. This is a cyan dye-forming coupler and would normally be used in an emulsion layer with a red sensitizing dye. To facilitate analysis in a single layer coating, green sensitizing dyes were also being coated with this coupler. It is understood, however, that for traditional photographic applications the green sensitizing dyes of this invention would be used in combination with a magenta dye forming coupler.

C-1

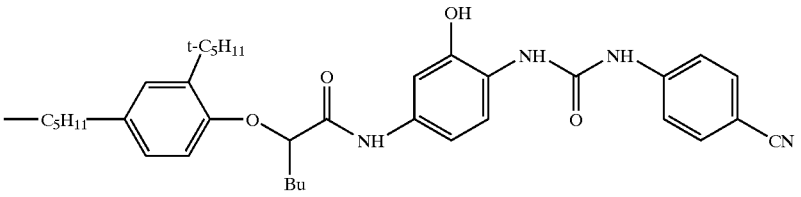

Sensitometric exposures (0.01 sec) were done using a tungsten exposure with filtration to simulate a daylight exposure without the blue light. The described elements were processed for 3.25' in the known C-41 color process as described in *Brit. J. Photog. Annual* of 1988, p191–198 with the exception that the composition of the bleach solution was changed to comprise propylenediaminetetraacetic acid. To determine the spectral sensitivity distribution, the coatings were given a 0.01 second exposure on a wedge spectrographic instrument covering a wavelength range from 350 to 750 nm. The instrument contained a tungsten light source and a step tablet ranging in density from 0 to 3 density units in 0.3 density steps. Speed was read at 10 nm wavelength intervals at a density of 0.1 above fog. Correction for the instrument's variation in spectral irradiance with wavelength was done via computer. Speed is reported in 1/(ergs/cm$^2$) units. Results are shown in the Table IIIa and IIIb.

TABLE IIIa

Sensitometric Evaluation of Dyes in Photographic Example 1.

| Example | | First Dye (Level)[a] | Second Dye (Level)[a] | Third Dye (Level)[a] | Speed[b] (-log E) | Normalized Relative Sensitivity[c] |
|---|---|---|---|---|---|---|
| 2-1 | C | I-6 (0.80) | — | — | 2.69 | 100 |
| 2-2 | I | I-6 (0.80) | II-13 (0.80) | III-8 0.40) | 2.77 | 120 |

I = invention, C is comparison.
[a]mmol dye/silver mole.
[b]speed at a density of 0.15 above fog from an exposure that simulates a daylight exposure filtered to remove the blue light.

TABLE IIIb

Spectral Sensitivity Evaluation of Dyes in Photographic Example 1.

| Example | | Spectral Sensitivity 550 nm | 550 nm Normalized Relative Speed | Spectral Sensitivity 530 nm | 530 nm Normalized Relative Speed |
|---|---|---|---|---|---|
| 2-1 | C | 1350 | 100 | 580 | 100 |
| 2-2 | I | 1421 | 105 | 759 | 131 |

It can be seen from Table IIIa that the dyes of the invention give enhanced photographic sensitivity. Spectral sensitivity evaluation (Table IIIb) indicates that the dyes maintain photographic sensitivity in the mid-green region (550 nm) but also afford increased sensitivity in the short green region (530 nm) relative to the comparison dye.

PHOTOGRAPHIC EVALUATION

EXAMPLE 2

The emulsion (0.0143 mole Ag), described in Example 1, was heated to 40° C. and sodium thiocyanate (120 mg/Ag mole) was added and after a 20' hold the first sensitizing dye (see Table IVa for dye and level) was added. After another 20' the second sensitizing dye (see Table IVa for dye and level), if present, was added. After an additional 20' a gold salt (bis[2,3-dihydro-1,4,5-trimethyl-3-(thioxo-κS)-1H-1,2,4-triazoliumato]-gold, tetrafluoroborate, 2.2 mg/Ag mole), sulfur agent (N-((dimethylamino)thioxomethyl)-N-methylglycine, sodium salt, 2.3 mg/Ag mole) and an antifoggant (3-(3-((methylsulfonyl)amino)-3-oxopropyl)-benzothiazolium tetrafluoroborate), 45 mg/Ag mole) were added at 5' intervals, the melt was held for 20' and then heated to 60° C. for 20'. After cooling to 40° C., 75 mg/Ag Mole of 1-(3-acetamidophenyl)-5-mercaptotetrazole (75 mg/Ag mole) was added. The third dye was added (see Table IVa for dye and level), when present, and in some cases a fourth dye (see Table IVa for dye and level), when present, was added to the melt. After 30' at 40° C., gelatin (647 g/Ag mole total), distilled water (sufficient to bring the final concentration to 0.11 Ag mmole/g of melt) and tetrazaindine (1.0 g/Ag mole) were added. Coating and evaluations were carried out in color format as described in Example 1. Results are listed in Table IVa, IVb and IVc.

TABLE IVa

Sensitometric Evaluation of Dyes in Photographic Example 2.

| Example | | First Dye | First Dye Level[a] | Second Dye | Second Dye Level[a] | Third Dye | Third Dye Level[a] | Fourth Dye | Fourth Dye Level[a] | Speed[b] (-log E) | Relative Speed |
|---|---|---|---|---|---|---|---|---|---|---|---|
| 3-1 | C | I-4 | 0.75 | I-5 | 0.17 | — | — | — | — | 2.87 | 100 |
| 3-2 | I | I-4 | 0.75 | I-5 | 0.17 | II-9 | 0.76 | | | 3.06 | 155 |
| 3-3 | I | I-4 | 0.75 | I-5 | 0.17 | II-9 | 0.76 | I-6 | 0.38 | 3.10 | 170 |

TABLE IVa-continued

Sensitometric Evaluation of Dyes in Photographic Example 2.

| Example | | First Dye | First Dye Level[a] | Second Dye | Second Dye Level[a] | Third Dye | Third Dye Level[a] | Fourth Dye | Fourth Dye Level[a] | Speed[b] (-log E) | Relative Speed |
|---|---|---|---|---|---|---|---|---|---|---|---|
| 3-4 | I | I-4 | 0.75 | I-5 | 0.17 | II-9 | 0.76 | III-3 | 0.38 | 3.15 | 204 |
| 3-5 | C | I-9 | 0.76 | — | — | — | — | — | — | 2.87 | 100 |
| 3-6 | I | I-9 | 0.76 | — | — | II-9 | 0.76 | I-6 | 0.38 | 3.18 | 178 |

I = invention, C is comparison.

[a]mmol dye/silver mole.

[b]speed at a density of 0.15 above fog from an exposure that simulates a daylight exposure filtered to remove the blue light.

TABLE IVb

Spectral Sensitivity Evaluation of Dyes in Photographic Example 2.

| Example | | Spectral Sensitivity 550 nm | 550 nm Normalized Relative Speed | Spectral Sensitivity 540 nm | 540 nm Normalized Relative Speed | Spectral Sensitivity 530 nm | 530 nm Normalized Relative Speed |
|---|---|---|---|---|---|---|---|
| 3-1 | C | 1140 | 100 | 962 | 100 | 681 | 100 |
| 3-2 | I | 901 | 79 | 1058 | 110 | 978 | 144 |
| 3-3 | I | 1106 | 97 | 1172 | 122 | 1059 | 156 |
| 3-4 | I | 1475 | 129 | 1807 | 188 | 1815 | 266 |

TABLE IVc

Spectral Sensitivity Evaluation of Dyes in Photographic Example 2.

| Example | | Spectral Sensitivity 590 nm | 590 nm Normalized Relative Speed | Spectral Sensitivity 570 nm | 570 nm Normalized Relative Speed | Spectral Sensitivity 550 nm | 550 nm Normalized Relative Speed | Spectral Sensitivity 530 nm | 530 nm Normalized Relative Speed |
|---|---|---|---|---|---|---|---|---|---|
| 3-5 | C | 1436 | 100 | 469 | 100 | 294 | 100 | 202 | 100 |
| 3-6 | I | 1467 | 102 | 555 | 118 | 885 | 301 | 1155 | 572 |

PHOTOGRAPHIC EVALUATION

EXAMPLE 3

The emulsion (0.0143 mole Ag), described in Example 1, was heated to 40° C. and sodium thiocyanate (100 mg/Ag mole) was added and after a 20' hold the first sensitizing dye (see Table Va for dye and level) was added. After an additional 20' a gold salt (bis[2,3-dihydro-1,4,5-trimethyl-3-(thioxo-kS)-1H-1,2,4-triazoliumato]-gold, tetrafluoroborate, 2.4 mg/Ag mole), sulfur agent (N-((dimethylamino)thioxomethyl)-N-methyl-glycine, sodium salt, 2.3 mg/Ag mole) and an antifoggant (3-(3-((methylsulfonyl)amino)-3-oxopropyl)benzothiazolium tetrafluoroborate), 37 mg/Ag mole) were added at 5' intervals, the melt was held for 20' and then heated to 60° C. for 20'. After cooling to 40° C., 75 mg/Ag Mole of 1-(3-acetamidophenyl)-5-mercaptotetrazole (75 mg/Ag mole) was added. The second dye was added (see Table Va for dye and level) to the melt.

Single-layer coatings in color format were made on acetate support in color format as described in Example 1 except that a coupler dispersion containing the yellow dye-forming coupler C-2 was substituted for the cyan dye-forming coupler in Example 1. Evaluations were carried out as described in Example 1. Results are listed in Table Va and Vb.

C-2

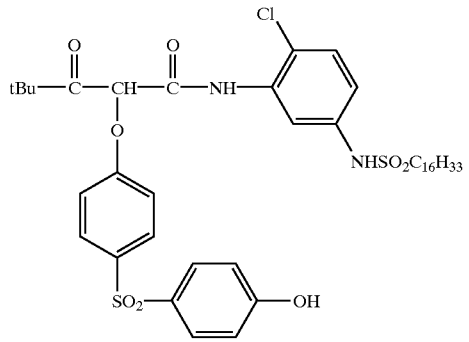

TABLE Va

Sensitometric Evaluation of Dyes in Photographic Example 3.

| Example | | First Dye | First Dye Level[a] | Second Dye | Second Dye Level[a] | Speed[b] (-log E) | Relative Speed |
|---|---|---|---|---|---|---|---|
| 4-1 | C | I-1 | 1.00 | — | 1.00 | 2.79 | 100 |
| 4-2 | I | I-1 | 1.00 | II-1 | 1.00 | 2.87 | 120 |
| 4-3 | I | I-1 | 1.00 | II-4 | 1.00 | 2.88 | 123 |

I = invention, C is comparison.
[a]mmol dye/silver mole.
[b]speed at a density of 0.15 above fog from an exposure that simulates a daylight exposure filtered to remove the blue light.

TABLE Vb

Spectral Sensitivity Evaluation of Dyes in Photographic Example 3

| Example | | Spectral Sensitivity 470 nm | 470 nm Normalized Relative Speed[c] | Spectral Sensitivity 440 nm | 440 nm Normalized Relative Speed[c] |
|---|---|---|---|---|---|
| 4-1 | C | 929 | 100 | 272 | 100 |
| 4-2 | I | 866 | 93 | 571 | 210 |
| 4-3 | I | 851 | 92 | 581 | 214 |

It can be seen from Table Va that the dyes of the invention give enhanced photographic sensitivity. Spectral sensitivity evaluation (Table Vb) indicates that the dyes maintain photographic significant sensitivity in the long blue region (470 nm) and afford increased sensitivity in the mid blue region (440 nm) relative to the comparison dye.

PHOTOGRAPHIC EVALUATION

EXAMPLE 4

An emulsion (0.0143 mole Ag), prepared as described in Example 1, was heated to 40° C. and sodium thiocyanate (120 mg/Ag mole) was added and after a 20' hold the first sensitizing dye (see Table VIa for dye and level) was added. After another 20' the second sensitizing dye (see Table VIa for dye and level) was added. After an additional 20' a gold salt (bis[2,3-dihydro-1,4,5-trimethyl-3-(thioxo-κS)-1H-1,2,4-triazoliumato]-gold, tetrafluoroborate, 2.2 mg/Ag mole), sulfur agent (N-((dimethylamino)thioxomethyl)-N-methylglycine, sodium salt, 2.3 mg/Ag mole) and an antifoggant (3-(3-((methylsulfonyl)amino)-3-oxopropyl)-benzothiazolium tetrafluoroborate), 45 mg/Ag mole) were added at 5' intervals, the melt was held for 20' and then heated to 60° C. for 20'. After cooling to 40° C., 75 mg/Ag Mole of 1-(3-acetamidophenyl)-5-mercaptotetrazole (75 mg/Ag mole) was added. The third dye was added (see Table VIa for dye and level), when present, to the melt. After 30' at 40° C., gelatin (647 g/Ag mole total), distilled water (sufficient to bring the final concentration to 0.11 Ag mmole/g of melt) and tetrazaindine (1.0 g/Ag mole) were added. Coating and evaluations were carried out in color format as described in Example 1. Results are listed in Table VIa and VIb.

TABLE VIa

Sensitometric Evaluation of Dyes in Photographic Example 4.

| Example | | First Dye | First Dye Level[a] | Second Dye | Second Dye Level[a] | Third Dye | Third Dye Level[a] | Speed[b] (-log E) | Relative Speed |
|---|---|---|---|---|---|---|---|---|---|
| 4-1 | C | I-10 | 0.4 | III-3 | 0.4 | — | — | 2.82 | 100 |
| 4-2 | I | I-10 | 0.4 | III-3 | 0.4 | II-22 | 0.8 | 2.90 | 120 |
| 4-3 | C | I-9 | 0.4 | III-3 | 0.4 | — | — | 2.80 | 100 |
| 4-4 | I | I-9 | 0.4 | III-3 | 0.4 | II-22 | 0.8 | 2.89 | 123 |

I = invention, C is comparison.

[a]mmol dye/silver mole.

[b]speed at a density of 0.15 above fog from an exposure that simulates a daylight exposure filtered to remove the blue light.

TABLE VIb

Spectral Sensitivity Evaluation of Dyes in Photographic Example 4.

| Example | | Spectral Sensitivity 590 nm | 590 nm Normalized Relative Speed | Spectral Sensitivity 550 nm | 550 nm Normalized Relative Speed | Spectral Sensitivity 530 nm | 530 nm Normalized Relative Speed |
|---|---|---|---|---|---|---|---|
| 4-1 | C | 850 | 100 | 391 | 100 | 731 | 100 |
| 4-2 | I | 747 | 88 | 765 | 196 | 806 | 110 |
| 4-3 | C | 677 | 100 | 350 | 100 | 777 | 100 |
| 4-4 | I | 611 | 91 | 729 | 208 | 792 | 102 |

It can be seen from Table VIa that the dyes of the invention give enhanced photographic sensitivity. Spectral sensitivity evaluation (Table VIb) indicates that the dyes maintain significant photographic sensitivity in the long green region (590 nm) and short green (530 nm) region and afford increased sensitivity in the mid-green region (550 nm) relative to the comparison dye.

PHOTOGRAPHIC EVALUATION

EXAMPLE 5

An emulsion (0.0143 mole Ag), precipitated as described in Example 1, was heated to 40° C. and sodium thiocyanate (100 mg/Ag mole) was added and after a 20' hold the first sensitizing dye (see Table VIIa for dye and level) was added. After an additional 20' a gold salt (bis[2,3-dihydro-1,4,5-trimethyl-3-(thioxo-kS)-1H-1,2,4-triazoliumato]-gold, tetrafluoroborate, 2.4 mg/Ag mole), sulfur agent (N-((dimethylamino)thioxomethyl)-N-methyl-glycine, sodium salt, 2.3 mg/Ag mole) and an antifoggant (3-(3-((methylsulfonyl)amino)-3-oxopropyl)-benzothiazolium tetrafluoroborate), 37 mg/Ag mole) were added at 5' intervals, the melt was held for 20' and then heated to 60° C. for 20'. After cooling to 40° C., 75 mg/Ag Mole of 1-(3-acetamidophenyl)-5-mercaptotetrazole (75 mg/Ag mole) was added. The second dye, when present, was added (see Table VIIa for dye and level) to the melt.

Single-layer coatings in color format were made on acetate support in color format as described in Example 1 except that a coupler dispersion containing the yellow dye-forming coupler C-2 was substituted for the cyan dye-forming coupler in Example 1. Evaluations were carried out as described in Example 1. Results are listed in Table VIIa and VIIb.

TABLE VIIa

Sensitometric Evaluation of Dyes in Photographic Example 5.

| Example | | First Dye | First Dye Level[a] | Second Dye | Second Dye Level[a] | Speed[b] (-log E) | Relative Speed |
|---|---|---|---|---|---|---|---|
| 5-1 | C | I-1 | 1.00 | — | 1.00 | 2.80 | 100 |
| 5-2 | I | I-1 | 1.00 | II-5 | 1.00 | 2.90 | 126 |
| 5-3 | I | I-1 | 1.00 | II-7 | 1.00 | 2.97 | 148 |
| 5-3 | I | I-1 | 1.00 | II-8 | 1.00 | 3.01 | 162 |

I = invention, C is comparison.
[a]mmol dye/silver mole.
[b]speed at a density of 0.15 above fog from an exposure that simulates a daylight exposure filtered to remove the blue light.

It can be seen from Table VIIa that the dyes of the invention give enhanced photographic sensitivity. Spectral sensitivity evaluation (Table VIIb) indicates that the dyes maintain photographic significant sensitivity in the long blue region (470 nm) and afford increased sensitivity in the mid blue region (460 nm and 450 nm) relative to the comparison dye.

The invention has been described in detail with particular reference to preferred embodiments, but it will be understood that variations and modifications can be effected within the spirit and scope of the invention.

What is claimed is:

1. A silver halide photographic material comprising at least one silver halide emulsion comprising silver halide grains having associated therewith a combination of two or more dyes comprising:

(a) a first dye which is a cyanine dye of formula Ia and has a net charge of zero or −1

(Ia)

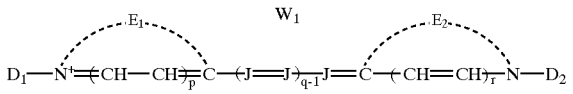

wherein:

$E_1$ and $E_2$ may be the same or different and represent the atoms necessary to form a substituted or unsubstituted heterocyclic ring which is a basic nucleus each J independently represents a substituted or unsubstituted methine group;

q is a positive integer of from 1 to 4;

p and r each independently represents 0 or 1;

$D_1$ and $D_2$ each independently represents substituted or unsubstituted alkyl or substituted or unsubstituted aryl and at least one of $D_1$ and $D_2$ contains an anionic substituent; and $W_1$ is one or more a counterions as necessary to balance the charge;

(b) a second dye which has at least one substituent that has a positive charge, and is a cyanine dye a merocyanine dye, arylidene dye, complex cyanine dye, complex merocyanine dye, homopolar cyanine dye, hemicyanine dye, styryl dye, hemioxonol dye, oxonol dye, anthraquinone dye, triphenylmethane dye, azo dye, azomethines, or a coumarin dye, with the proviso that if the second dye is a cyanine dye, it is of formula IIa:

TABLE VIIb

Spectral Sensitivity Evaluation of Dyes in Photographic Example 5

| Example | | Spectral Sensitivity 470 nm | 470 nm Normalized Relative Speed[c] | Spectral Sensitivity 460 nm | 460 nm Normalized Relative Speed[c] | Spectral Sensitivity 450 nm | 450 nm Normalized Relative Speed[c] |
|---|---|---|---|---|---|---|---|
| 5-1 | C | 944 | 100 | 648 | 100 | 452 | 100 |
| 5-2 | I | 872 | 92 | 873 | 135 | 761 | 168 |
| 5-3 | I | 1259 | 133 | 1086 | 168 | 1208 | 267 |
| 5-4 | I | 1094 | 116 | 1021 | 158 | 924 | 204 |

(IIa)

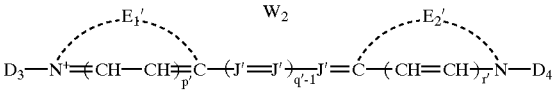

wherein:

E1' and $E_2$' may be the same or different and represent the atoms necessary to form a substituted or unsubstituted heterocyclic ring which is a basic nucleus, with the proviso that E1' and $E_2$' of formula IIa are not the same as $E_1$ and $E_2$ of formula (Ia);

each J' independently represents a substituted or unsubstituted methine group;

q' is a positive integer of from 1 to 4;

p' and r' each independently represents 0 or 1;

$D_3$ and $D_4$ each independently represents substituted or unsubstituted alkyl or substituted or unsubstituted aryl and at least one of E1', $E_2$', J' or $D_3$ and $D_4$ contains a cationic substituent;

$W_2$ is one or more a counterions as necessary to balance the charge; and wherein (c) the wavelength of maximum light absorption, in nanometers (nm), of the first dye and the wavelength of maximum light absorption of the second dye differ by at least 10 nm.

2. A silver halide photographic material according to claim 1, wherein the first dye forms a J-aggregate and/or the second dye forms a J-aggregate.

3. A silver halide photographic material according to claim 1, wherein the second dye is a merocyanine dye, arylidene dye, complex cyanine dye, complex merocyanine dye, homopolar cyanine dye, hemicyanine dye, styryl dye, hemioxonol dye, oxonol dye, anthraquinone dye, triphenylmethane dye, azo dye, azomethines, or a coumarin dye.

4. A silver halide photographic material according to claim 1, wherein at least one dye affords maximum light absorption that is between 510 and 545 nm and at least one dye affords a maximum light absorption between 545 and 590 nm.

5. A silver halide photographic material according to claim 1, wherein at least one dye affords maximum light absorption that is between 520 and 540 nm and at least one dye affords a maximum light absorption between 540 and 560 nm.

6. A silver halide photographic material according to claim 1, wherein at least one dye affords maximum light absorption that is between 510 and 540 nm and at least one dye affords a maximum light absorption between 540 and 560 nm and at least one dye affords a maximum light absorption between 560 and 590 nm.

7. A silver halide photographic material according to claim 1, wherein at least one dye affords a maximum light absorption that is between 410 and 460 nm and at least one dye affords a maximum light absorption between 460 and 490 nm.

8. A silver halide photographic material according to claim 1, wherein at least one dye affords a maximum light absorption that is between 610 and 635 nm and at least one dye affords a maximum light absorption between 635 and 690 nm.

9. A silver halide photographic material according to claim 1, wherein at least one dye of formula I is present

I

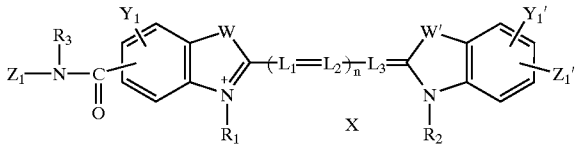

wherein:

W and W' represent independently an O atom, a S atom, a Se atom or a NR' group wherein R' is a substituted or unsubstituted alkyl group;

$Z_1$ represents a substituted or unsubstituted aromatic group;

$Z_1$' independently represents a substituted or unsubstituted aromatic group which may be appended directly to the dye or $Z_1$' represents $LZ_2$ where L represents a linking group and $Z_2$ represents a substituted or unsubstituted aromatic group or substituted or unsubstituted alkyl group;

$L_1$, $L_2$, and $L_3$ independently represent methine groups bearing a hydrogen, substituted or unsubstituted alkyl group, or a halogen atom;

n represents 0 or 1;

$Y_1$ and $Y_1$' independently represent hydrogen, substituted or unsubstituted alkyl group, a substituted or unsubstituted aromatic group, a halogen atom, an acylamino group, a carbamoyl group, a carboxy group, or a substituted or unsubstituted alkoxy group;

$R_1$ or $R_2$ independently represent a substituted or unsubstituted alkyl group and at least one of $R_1$ or $R_2$ is substituted with a positively charged substituent or at least one of $R_1$ or $R_2$ is substituted with a negatively charged substituent;

$R_3$ is hydrogen or a substituted or unsubstituted alkyl group;

X is one or more ions as needed to balance the charge on the molecule.

10. A silver halide photographic material according to claim 1 comprising at least one silver halide emulsion having associated therewith at least one dye of formula II

II

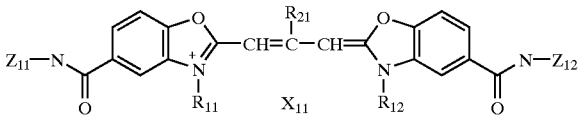

wherein:

$Z_{11}$ and $Z_{12}$ independently represents a substituted or unsubstituted aromatic group;

$R_{21}$ is H or a substituted or unsubstituted lower alkyl group or a substituted or unsubstituted aryl group;

$R_{11}$ and $R_{12}$ independently represent substituted or unsubstituted alkyl group and at least one of $R_{11}$ and $R_{12}$ is substituted with a positively charged substituent or at least one of $R_{11}$ and $R_{12}$ is substituted with a negatively charged substituent;

$X_{11}$ is one or more ions as needed to balance the charge on the molecule.

11. A silver halide photographic material according to claim 1, wherein at least one dye of formula III is present

III

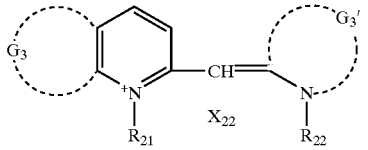

wherein:

$R_{21}$ and $R_{22}$ each independently represent substituted or unsubstituted alkyl group and at least one of $R_{21}$ and $R_{22}$ is substituted with a positively charged substituent or at least one of $R_{21}$ and $R_{22}$ is substituted with a negatively charged substituent;

$G_3$ represents represent the atoms necessary to complete a substituted or unsubstituted benzene which may contain fused aromatic rings;

$G_3$ represents the atoms necessary to complete a substituted or unsubstituted benzothiazole, benzoselenazole, or a benzoxazole nucleus which may contain fused aromatic rings;

$X_{22}$ is one or more ions as needed to balance the charge on the molecule.

12. A silver halide photographic material according to claim 1, wherein at least one dye of formula IV is present

IV

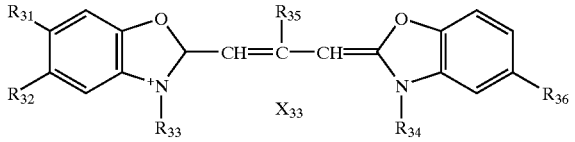

wherein:

$R_{31}$ and $R_{32}$ independently represent hydrogen, substituted or unsubstituted alkyl groups, substituted or unsubstituted aryl groups, substituted or unsubstituted aryloxy groups, halogen atoms, substituted or unsubstituted alkoxycarbonyl groups, substituted or unsubstituted acylamino groups, substituted or unsubstituted acyl groups, cyano groups, substituted or unsubstituted carbamoyl groups, substituted or unsubstituted sulfamoyl groups, carboxyl groups, or a substituted or unsubstituted acyloxy groups, provided that $R_{31}$ and $R_{32}$ do not represent hydrogen atoms at the same time;

$R_{35}$ represents a hydrogen atom, an substituted or unsubstituted alkyl group, or a substituted or unsubstituted aryl group;

$R_{36}$ represents a branched butyl, branched pentyl, branched hexyl, cyclohexyl, branched octyl, benzyl or phenethyl group, and moreover $R_{36}$ is required to be a substituent having such L and B that S value is 544 or less in the equation of $$S=3.536L-2.661B+535.4$$

wherein L represents a STERIMOL parameter (in angstroms.), and B represents the smaller value among $B_1+B_4$ and $B_2+B_3$ which are each sums of STERIMOL parameters (their units are angstroms);

$X_{33}$ represents a counter anion if necessary, $R_{33}$ and $R_{34}$ independently represent substituted or unsubstituted alkyl groups and at least one of $R_{33}$ and $R_{34}$ is substituted with a positively charged substituent or at least one of $R_{33}$ and $R_{34}$ is substituted with a negatively charged substituent.

13. A silver halide photographic material according to claim 1, wherein at least one dye of formula V is present

V

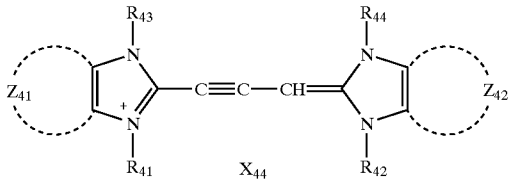

wherein:

$R_{41}$ and $R_{42}$ each represents independently a substituted or unsubstituted alkyl group and at least one of $R_{41}$ and $R_{42}$ is substituted with a positively charged substituent or at least one of $R_{41}$ and $R_{42}$ is substituted with a negatively charged substituent;

$Z_{41}$ and $Z_{42}$ independently represent the atoms necessary to complete a substituted or unsubstituted benzene ring which may contain fused aromatic rings;

$X_{44}$ is one or more ions as needed to balance the charge on the molecule.

14. A silver halide photographic material according to claim 1, wherein at least one dye of formula VI is present

VI

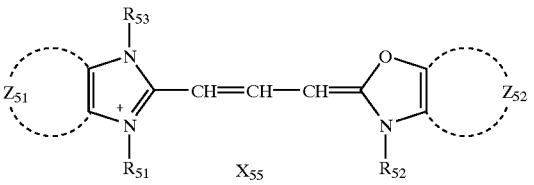

wherein:

$R_{51}$ and $R_{52}$ each represents independently a substituted or unsubstituted alkyl group and at least one of $R_{51}$ and $R_{52}$ is substituted with a positively charged substituent or at least one of $R_{51}$ and $R_{52}$ is substituted with a negatively charged substituent;

$Z_{51}$ and $Z_{52}$ independently represent the atoms necessary to complete a substituted or unsubstituted benzene ring which may contain fused aromatic rings;

$X_{55}$ is one or more ions as needed to balance the charge on the molecule.

15. A silver halide photographic material according to claim 1, wherein at least one dye of formula VII is present

VII

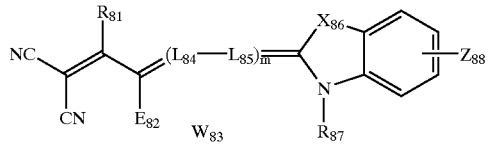

wherein:

$X_{86}$ independently represent S, Se, O, N—R', or C(Ra, Rb), wherein Ra and Rb independently represent substituted or unsubstituted alkyl groups, $E_{82}$ represents an electron-withdrawing group $R_{81}$ represents a substituted or unsubstituted aromatic or heteroaromatic group, a substituted or unsubstituted alkyl or hydrogen, $R_{87}$ represents a substituted or unsubstituted alkyl group, $L_{84}$, $L_{85}$ independently represents a substituted or unsubstituted methine group, m may be 1, or 2, $Z_{88}$ is hydrogen or one or more substituents including possible fused rings, at least one of $R_{81}$, $L_{84}$, $L_{85}$, $Z_{88}$, $R_{87}$ has a substituent with a positive charge or a substituent with a negative charge present, $W_{83}$ is one or more counterions to balance the charge.

16. A silver halide photographic material according to claim 1, wherein at least one dye of Formula VIII is present:

VIII

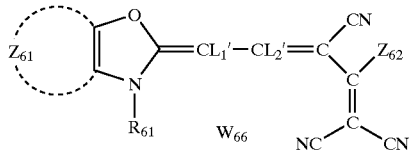

wherein:

$Z_{61}$ represent the atoms necessary to complete a substituted or unsubstituted benzene which may contain fused aromatic rings;

$Z_{62}$ represents a substituted or unsubstituted aromatic or heteroaromatic group;

$R_{61}$ represents a substituted alkyl group containing a positively charged substituent;

$L_1'$ and $L_2'$ represents hydrogen, or substituted or unsubstituted alkyl or aryl;

$W_{66}$ is one or more ions as needed to balance the charge on the molecule.

17. A silver halide photographic material according to claim 1, which contains at least one dye of formula IX

IX

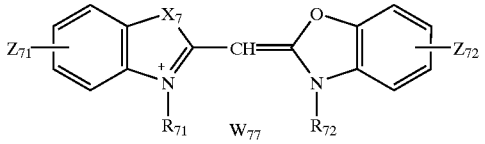

wherein:

$X_7$ represents independently O, S, $NR_{73}$, Se;

$R_{73}$, independently represents substituted or unsubstituted alkyl or substituted or unsubstituted aryl;

$R_{71}$ and $R_{72}$ each represents independently a substituted or unsubstituted alkyl group and at least one of $R_{71}$ and $R_{72}$ is substituted with a positively charged substituent or at least one of $R_{71}$ and $R_{72}$ is substituted with a negatively charged substituent;

$Z_{71}$ and $Z_{72}$, each independently represents hydrogen or one or more substituents which, optionally, may form fused aromatic rings;

$W_{77}$ is one or more ions as needed to balance the charge on the molecule.

18. A silver halide photographic material according to claim 17, wherein at least one of the dyes is substituted with at least one hydrogen bonding group.

19. A silver halide photographic material according to claim 17, wherein at least one of the dyes is substituted with a substituent of formula X

X

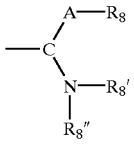

wherein:

$R_8$, $R_{8'}$, and $R_{8''}$ independently represent hydrogen or substituted or unsubstituted alkyl or substituted or unsubstituted aryl or a heteroatom and at least one of $R_8$, $R_{8'}$, or $R_{8''}$ independently represent hydrogen;

A independently represents N—$R_9$, O, or S;

$R_9$ represents hydrogen or substituted or unsubstituted alkyl or substituted or unsubstituted aryl;

$R_8$, $R_{8'}$, $R_{8''}$ and $R_9$ optionally may be part of one or more cyclic rings;

C atom in formula X may be connected to N or A or it's neighboring atom with either a single or a double bond.

20. A silver halide photographic material according to claim 17, wherein both $R_{71}$ and $R_{72}$ are substituted with a guanidinium group or an amidinium group, which could in turn be substituted or unsubstituted.

* * * * *